US012297028B2

(12) United States Patent
Siciliano et al.

(10) Patent No.: US 12,297,028 B2
(45) Date of Patent: May 13, 2025

(54) POLYMERIC CONTAINER INCLUDING A BODY WITH A PLURALITY OF OSCILLATIONS

(71) Applicant: AMCOR RIGID PACKAGING USA, LLC, Ann Arbor, MI (US)

(72) Inventors: John Siciliano, Dexter, MI (US); Tyler M. Nunnold, Brighton, MI (US); Michael T. Lane, Brooklyn, MI (US); James Stelzer, South Lyon, MI (US); Omkar Dole, Kalamazoo, MI (US)

(73) Assignee: AMCOR RIGID PACKAGING USA, LLC, Ann Arbor, MI (US)

( * ) Notice: Subject to any disclaimer, the term of this patent is extended or adjusted under 35 U.S.C. 154(b) by 30 days.

(21) Appl. No.: 18/266,051

(22) PCT Filed: Dec. 16, 2020

(86) PCT No.: PCT/US2020/065240

§ 371 (c)(1),
(2) Date: Jun. 8, 2023

(87) PCT Pub. No.: WO2022/132141

PCT Pub. Date: Jun. 23, 2022

(65) Prior Publication Data

US 2024/0092551 A1 Mar. 21, 2024

(51) Int. Cl.
*B65D 1/02* (2006.01)
*B65D 79/00* (2006.01)

(52) U.S. Cl.
CPC ..... *B65D 79/0084* (2020.05); *B65D 1/0207* (2013.01); *B65D 1/0223* (2013.01); *B65D 2501/0036* (2013.01)

(58) Field of Classification Search
CPC ..... B65D 79/0084
See application file for complete search history.

(56) References Cited

U.S. PATENT DOCUMENTS 5,690,244 A 11/1997 Darr
6,575,320 B2 * 6/2003 Ota ..... B65D 1/0223 215/381

(Continued)

FOREIGN PATENT DOCUMENTS

CO 98002868 1/1998
JP 2003531774 A 10/2003

(Continued)

OTHER PUBLICATIONS

International Search Report and Written Opinion of the ISA issued in PCT/US2020/065240, mailed Sep. 16, 2021; ISA/KR.

(Continued)

*Primary Examiner* — Don M Anderson
(74) *Attorney, Agent, or Firm* — Harness, Dickey & Pierce, P.L.C.

(57) ABSTRACT

A polymeric container including a finish defining an opening of the container, a base, and a body. The body is between the finish and the base. The body includes a flexible panel extending entirely around the container A longitudinal axis of the container extends through an axial center of the finish, the base, the body, and the flexible panel. The flexible panel includes alternating concave portions and vertically extending columns arranged about the flexible panel. In response to a vacuum within the container resulting from filling and capping the container, the concave portions are configured to flex inward towards the longitudinal axis to become more concave, and the vertically extending columns are configured to flex outward away from the longitudinal axis of the container.

23 Claims, 45 Drawing Sheets

(56) References Cited

U.S. PATENT DOCUMENTS

| | | | | |
|---|---|---|---|---|
| 6,763,969 | B1 | 7/2004 | Melrose et al. | |
| 6,935,525 | B2 * | 8/2005 | Trude | B65D 1/0223 215/381 |
| 2002/0104820 | A1 * | 8/2002 | Hong | B65D 1/0223 215/381 |
| 2003/0015491 | A1 * | 1/2003 | Melrose | B65D 79/0084 215/381 |
| 2005/0269284 | A1 * | 12/2005 | Pedmo | B65D 1/0223 215/381 |
| 2009/0283495 | A1 * | 11/2009 | Lane | B65D 79/0084 215/383 |
| 2010/0206892 | A1 * | 8/2010 | Mast | B65D 79/0084 220/669 |
| 2011/0108515 | A1 * | 5/2011 | Gill | B65D 79/0084 215/381 |
| 2011/0217494 | A1 * | 9/2011 | Lane | B65D 1/0276 428/35.7 |
| 2011/0220668 | A1 * | 9/2011 | Steih | B65D 1/0223 220/669 |
| 2012/0097635 | A1 * | 4/2012 | Yourist | B65D 23/0878 215/381 |
| 2013/0228249 | A1 * | 9/2013 | Gill | B65D 1/0223 220/666 |
| 2014/0166609 | A1 * | 6/2014 | Yourist | B65D 79/0084 215/383 |
| 2017/0225863 | A1 | 8/2017 | Lohmeier et al. | |
| 2017/0334628 | A1 * | 11/2017 | Bangi | B65D 79/0084 |
| 2021/0323745 | A1 * | 10/2021 | Uchiyama | B65D 1/0223 |
| 2022/0097912 | A1 * | 3/2022 | Lane | B65D 1/0246 |

FOREIGN PATENT DOCUMENTS

| | | | |
|---|---|---|---|
| WO | WO-2004069669 | A1 | 8/2004 |
| WO | WO-2004074116 | A2 | 9/2004 |

OTHER PUBLICATIONS

Extended European Search Report from counterpart EP209661354, dated Jul. 10, 2024.

Columbia Office Action from counterpart CO NC20230007515, dated Nov. 8, 2024.

* cited by examiner

POLYMERIC CONTAINER INCLUDING A BODY WITH A PLURALITY OF OSCILLATIONS

CROSS-REFERENCE TO RELATED APPLICATIONS

This application is a U.S. National Phase Patent Application under 35 U.S.C. 371 of International Application No. PCT/US2020/065240, filed on Dec. 16, 2020, the entire disclosure of which is incorporated herein by reference.

FIELD

The present disclosure relates to a polymeric container including a body with a plurality of oscillations.

BACKGROUND

This section provides background information related to the present disclosure, which is not necessarily prior art.

Polymeric containers are typically blow-molded into various sizes and shapes to hold liquid beverages such as water, juice, carbonated soda, and sauces, for example. The manufacturing process starts by injection molding a preform (or parrison) with various thermoplastics, such as polyethylene terephthalate (PET). The preform is then heated with lamps, stretched axially with a stretch rod, and blown with high pressure air into the container shape determined by the blow mold tooling.

In the packaging of beverages into polymeric containers, products such as juices, sauces, performance and vitamin drinks, for example, are typically "hot-filled" into the container at temperatures of 180 F (82 C) or higher and capped immediately after filling. As the liquid in the filled container cools to room temperature it also contracts, causing internal vacuum forces to act upon the side walls of the container, which can distort the intended shape of the container. To counteract this internal vacuum, containers must be designed to absorb and withstand the forces in a controlled manner so that the final shape of the container under vacuum maintains an acceptable aesthetic appearance.

Other external stresses act upon filled containers due secondary packaging and shipping. Containers are packing in cardboard boxes and/or plastic wrap, and stacked onto a pallet, which causes stress to the lower layers of product due to the weight from above. Therefore, containers must be designed to withstand this "top-load" without distortion or collapse.

In addition to issues of internal and external forces, containers must also be designed with the end user in mind by providing a visually attractive and ergonomically functional shape. One important aspect of the design is the grip, which must be convenient and easy to use for a wide range of consumers.

In the design of thermoplastic blow molded containers, the above mentioned concerns are usually addressed by providing sufficient wall material thickness and weight, combined with geometric structural features such as horizontal and vertical ribs, embossed and de-bossed shapes, and vacuum absorbing panels.

While existing containers are suitable for their intended use, they are subject to improvement. The present disclosure includes new polymeric containers that have numerous advantages and unexpected results, as explained in detail herein and as one skilled in the art will appreciate.

SUMMARY

This section provides a general summary of the disclosure, and is not a comprehensive disclosure of its full scope or all of its features.

The present disclosure includes a polymeric container having a finish defining an opening of the container, a base, and a body. The body is between the finish and the base. The body includes a flexible panel extending entirely around the container. A longitudinal axis of the container extends through an axial center of the finish, the base, the body, and the flexible panel. The flexible panel includes alternating concave portions and vertically extending columns arranged about the flexible panel. In response to a vacuum within the container resulting from filling and capping the container, the concave portions are configured to flex inward towards the longitudinal axis to become more concave, and the vertically extending columns are configured to flex outward away from the longitudinal axis of the container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Figure 14:
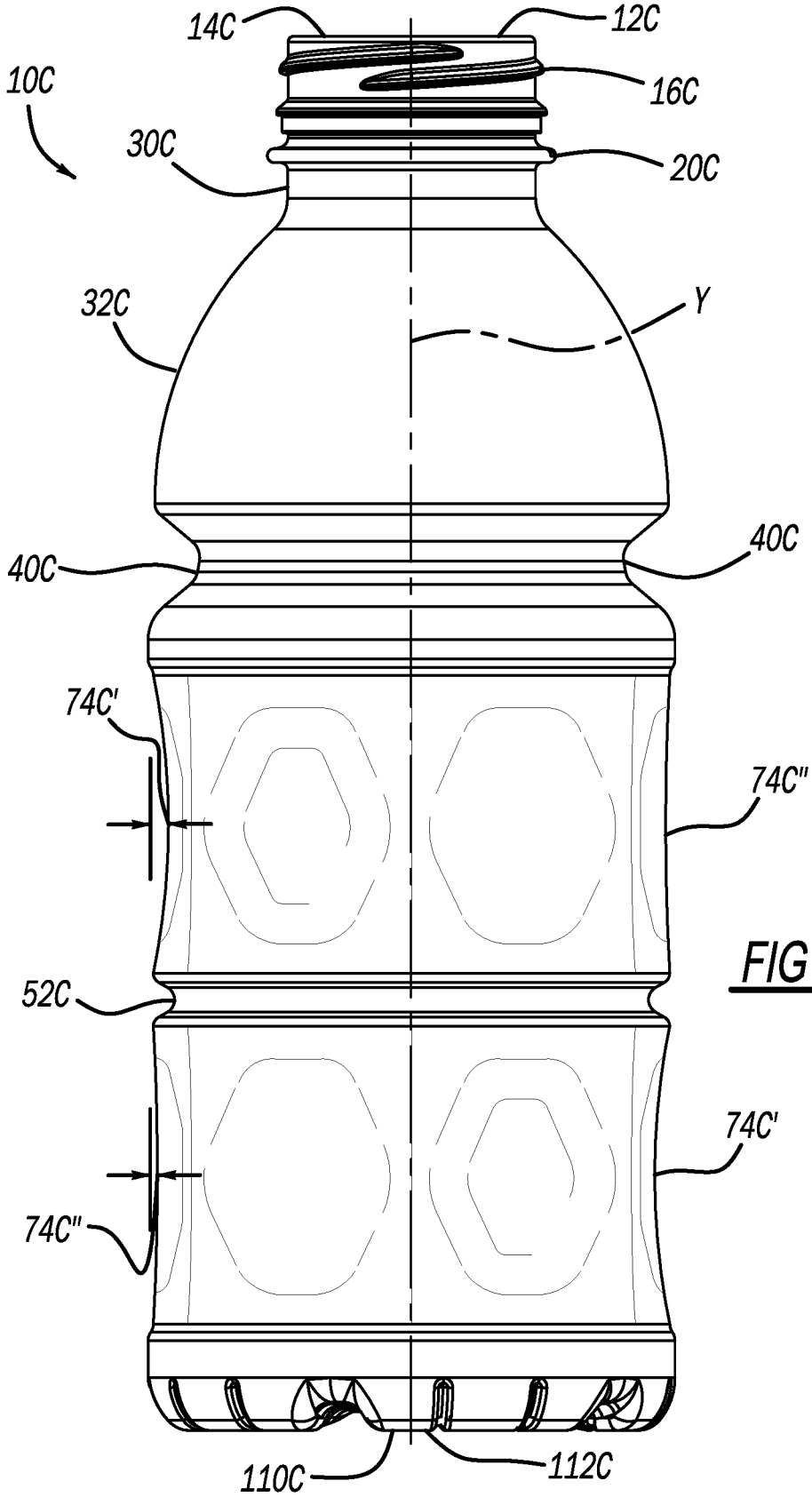
Figure 15:
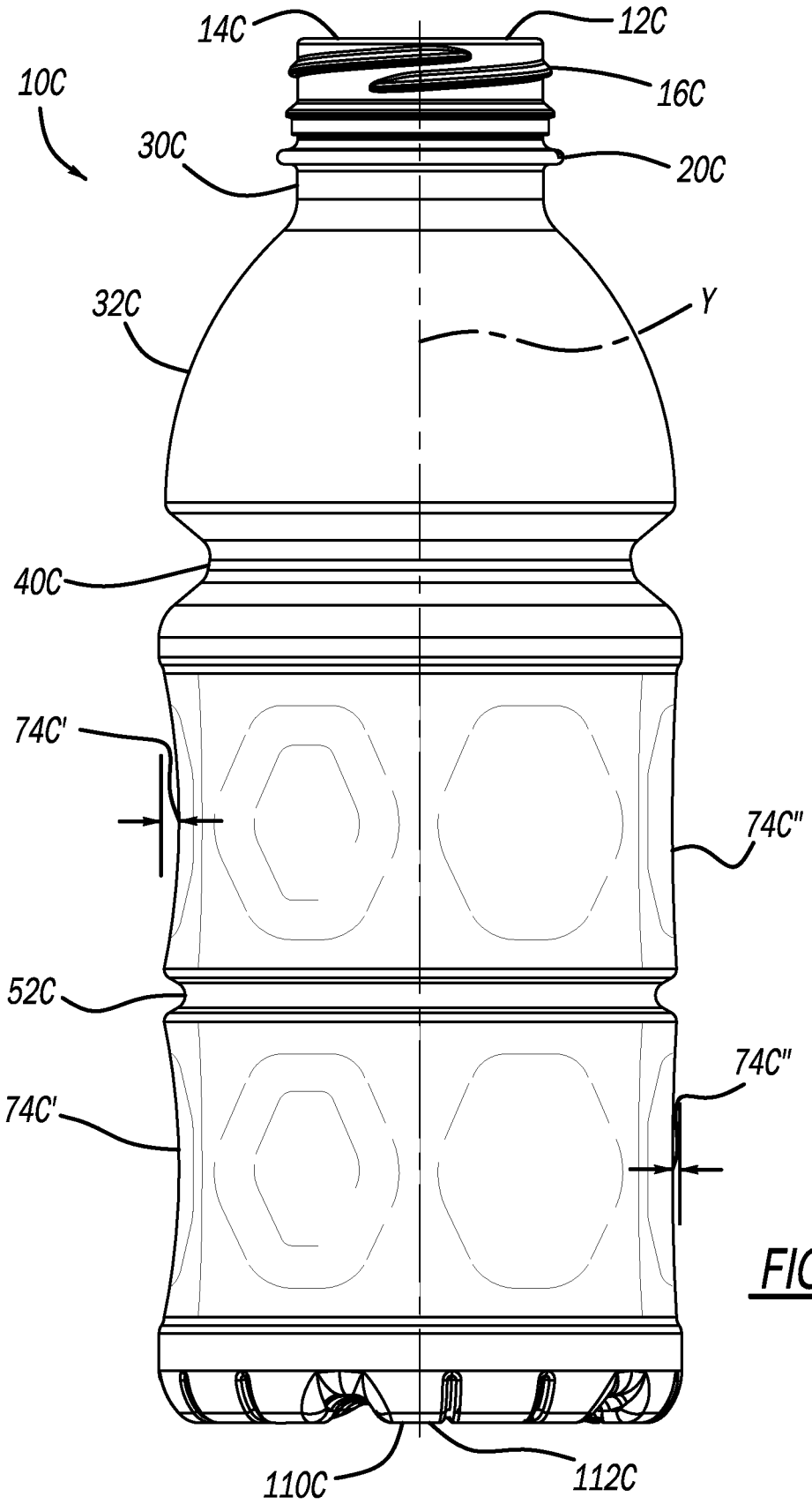

FIG. 14 is a side view of the third polymeric container configured with vertically aligned flexible panels that contract at different rates in response to a vacuum within the container as a result of filling and capping the container; and FIG. 15 is a side view of the third polymeric container configured with vertically offset flexible panels that contract at different rates in response to a vacuum within the container as a result of filling and capping the container.

Corresponding reference numerals indicate corresponding parts throughout the several views of the drawings.

DETAILED DESCRIPTION

Example embodiments will now be described more fully with reference to the accompanying drawings.

Figure 1A:
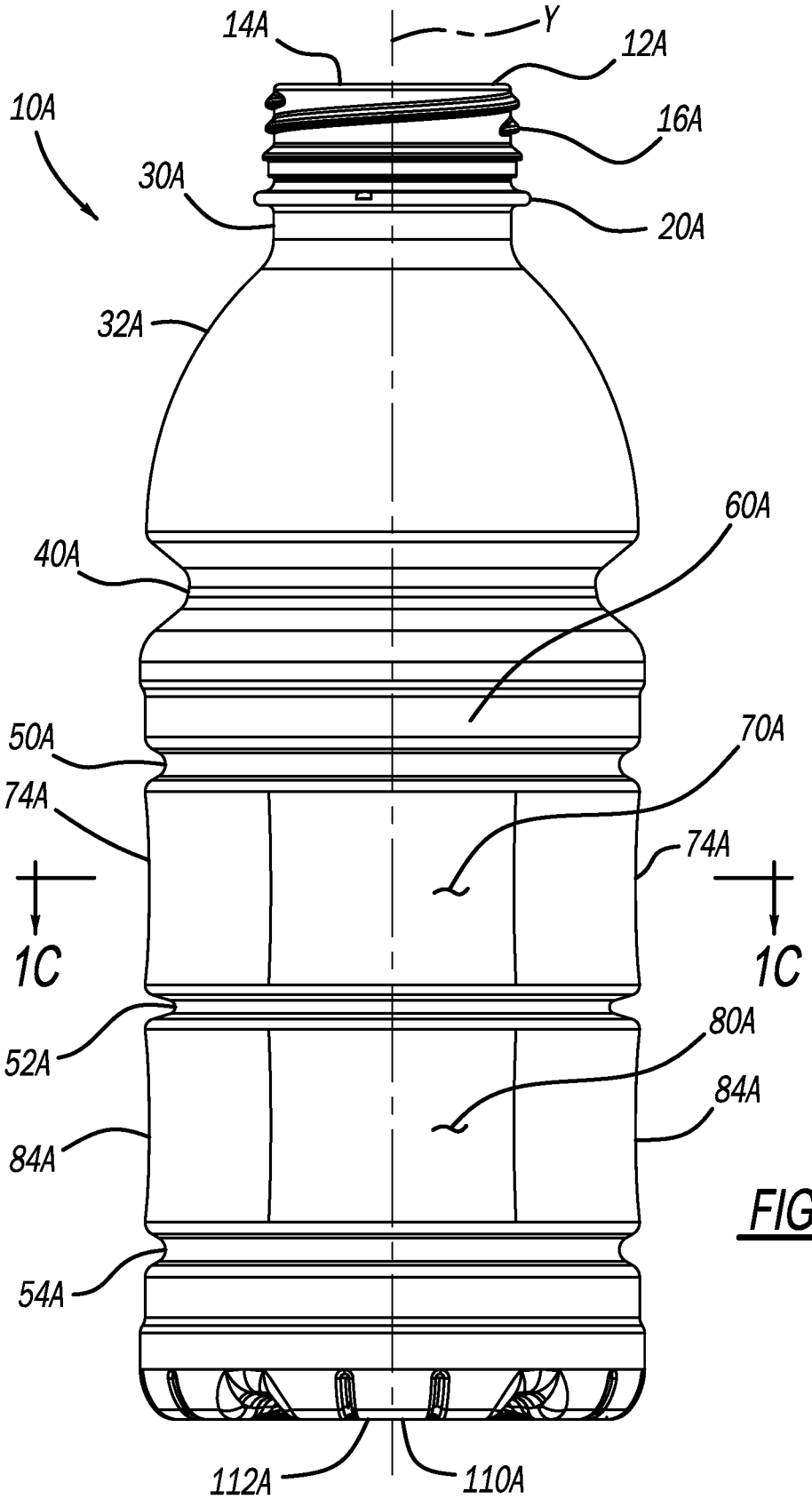
FIG. 1A is a side view of a first polymeric container in accordance with the present disclosure, the first polymeric container is in an as-blown, pre-filled configuration.
Figure 1B:
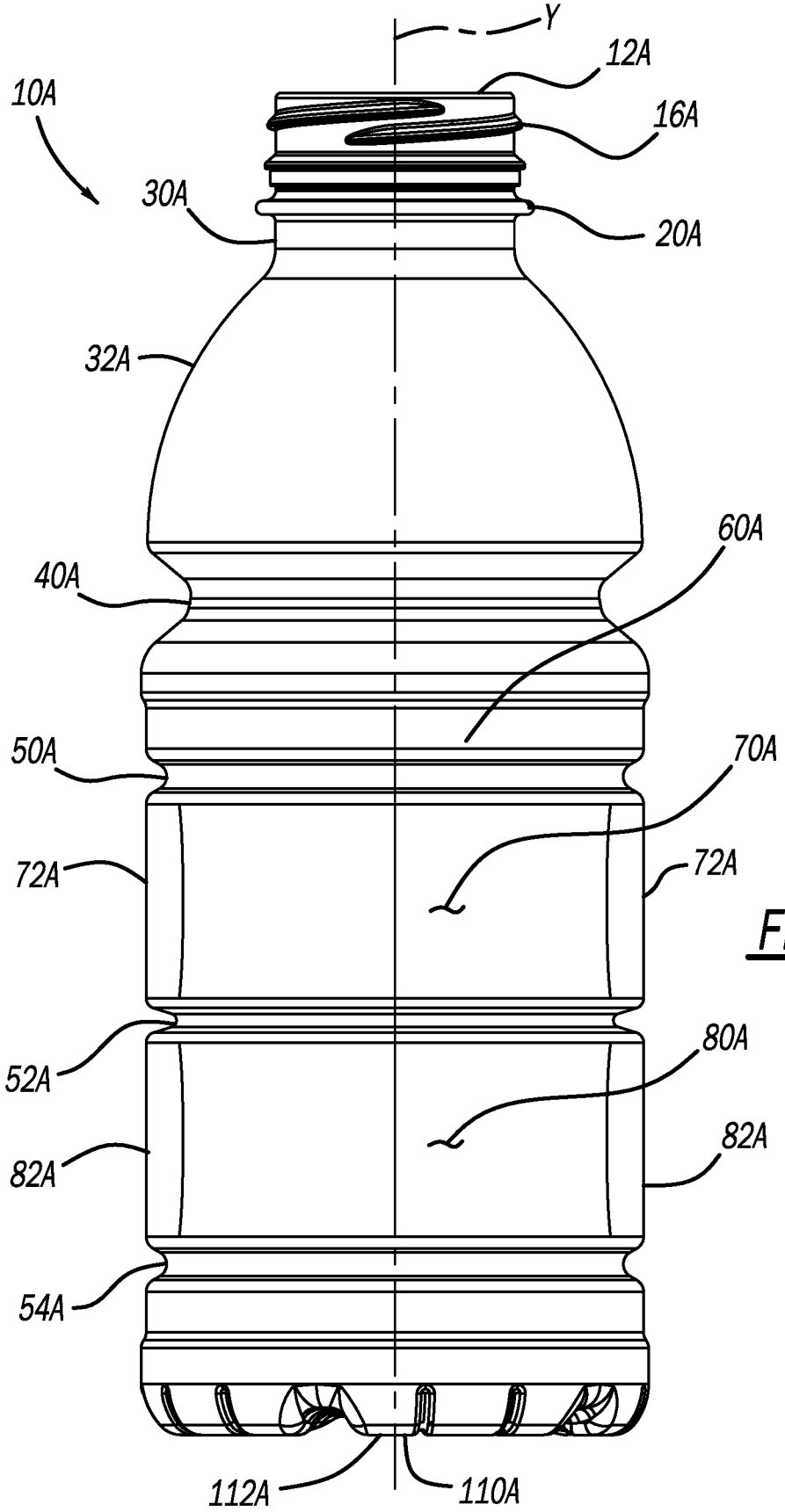
FIG. 1B is another side view of the container of FIG. 1A.

With initial reference to FIGS. 1A and 1B, an exemplary polymeric container in accordance with the present disclosure is illustrated at reference numeral 10A. The container 10A generally includes a finish 12A at a first end 14A of the container 10A. The finish 12A defines an opening of the container 10A. At an outer surface of the finish 12A are threads 16A. The threads 16A are configured to cooperate with corresponding threads of a closure to secure the closure to the finish 12A and close the container 10A.

Below the finish 12A is a neck 30A. Extending from the neck 30A is a shoulder 32A. The shoulder 32A extends to a body 60A of the container 10A. Between the shoulder 32A and the body 60A is a horizontal rib 40A. The body 60A may include any suitable number of additional ribs. For example, the body 60A may include ribs 50A, 52A, and 54A. The ribs 50A, 52A, and 54A extend entirely around the body 60A, and each one may be flexible or rigid ribs. In the example illustrated, the rib 52A is flexible, and the ribs 50A and 54A are rigid.

The body 60A further includes a first flexible panel 70A and a second flexible panel 80A, each of which extend around an entirety of the body 60A. The first and second flexible panels 70A and 80B may have any suitable sidewall thickness, such as 0.330 mm or less. The first flexible panel 70A is between the rib 50A and the rib 52A. The second flexible panel 80A is between the rib 52A and the rib 54A. Although two flexible panels 70A, 80A are illustrated, any suitable number of flexible panels may be included, such as a single flexible panel or more than two flexible panels. The first and second flexible panels 70A and 80A will be described further herein.

The container 10A further includes a base 110A at a second end of the container 10A, which is opposite to the first end 14A. The base 110A may be any suitable base, such as any suitable vacuum absorbing base. A longitudinal axis "y" of the container 10A extends through an axial center of the base 110A, an axial center of the finish 12A, and an axial center of the body 60A.

With continued reference to FIGS. 1A and 1B, and additional reference to FIG. 1C in particular, the first flexible panel 70A will now be described in additional detail. The first flexible panel 70A includes a plurality of concave portions 74A. The concave portions 74A are spaced apart at regular intervals about an entirety of the flexible panel 70A and the body 60A, and thus generally oscillate about the flexible panel 70A and around the container 10A. The concave portions 74A curve inward towards the longitudinal axis y, and are concave at an outer surface of the container 10. Between the concave portions 74A are vertically extending columns 72A. The vertically extending ribs 72A extend parallel to, or generally parallel to, the longitudinal axis y prior to the container 10A being filled and capped. The first flexible panel 70A may have any suitable number of concave portions 74A and vertically extending columns 72A. In the examples illustrated, the container 10A has six concave portions 74A and six vertically extending columns 72A. However, the container 10A may include 4-8 of each one of the concave portions 74A and vertically extending columns 72A, with there being an equal number of concave portions 74A and vertically extending columns 72A.

Figure 1C:
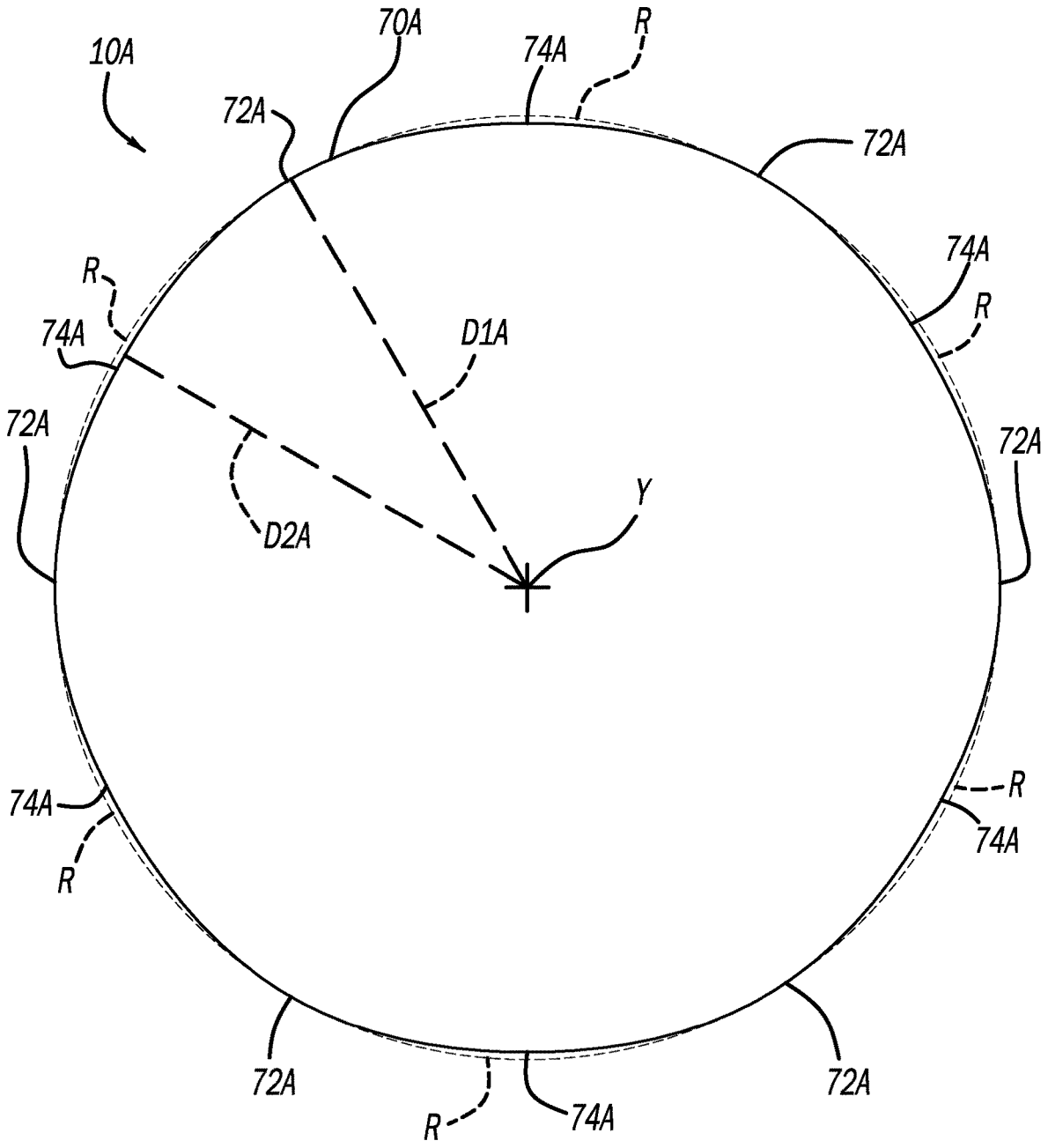
FIG. 1C is a cross-sectional view taken along line 1C-1C of FIG. 1A.

FIG. 1C illustrates a reference circle R, which touches, or nearly touches, each of the vertically extending columns 72A. The concave portions 74A are between the reference circle R and the longitudinal axis y. The concave portions 74A are recessed below the reference circle R by 0.60 mm, or about 0.60 mm. Thus, a distance D1A between the vertically extending columns 72A and the longitudinal axis y is greater than a distance D2A between the concave portions 74A and the longitudinal axis y. The flexible panel 70A has a first diameter between opposing vertically extending columns 72A, which is larger than a second diameter between opposing concave portions 74A. For example, the first diameter between opposing vertically extending columns 72A may be about 72.75 mm, and the second diameter between opposing vertically extending columns 72A may be 0.25 mm-2.5 mm or less, such as about 0.60 mm less. A radius of one of the vertically extending columns 72A is half a maximum diameter of the container 10A.

The second flexible panel 80A is substantially similar to, or the same as, the first flexible panel 70A. The rib 52A separates the first and second flexible panels 70A, 80A. The rib 52A may be flexible as illustrated in FIGS. 1A-5, which absorbs vacuum. The second flexible panel 80A includes concave portions 84A, which are substantially similar to, or the same as, the concave portions 74A. The second flexible panel 80A further includes vertically extending columns 82A, which are substantially similar to, or the same as, the vertically extending columns 72A. The concave portions 74A, 84A may be vertically aligned, or offset. Similarly, the vertically extending columns 72A, 82A may be vertically aligned, or offset.

The overall height of the first flexible panel 70A and/or the second flexible panel 80A may be 20%-50% of a total label panel height of the container 10A. The label panel may extend from about the rib 50B to the rib 54B. The concave portions 74A may be 40%-90% of a total label panel surface area.

Figure 2A:
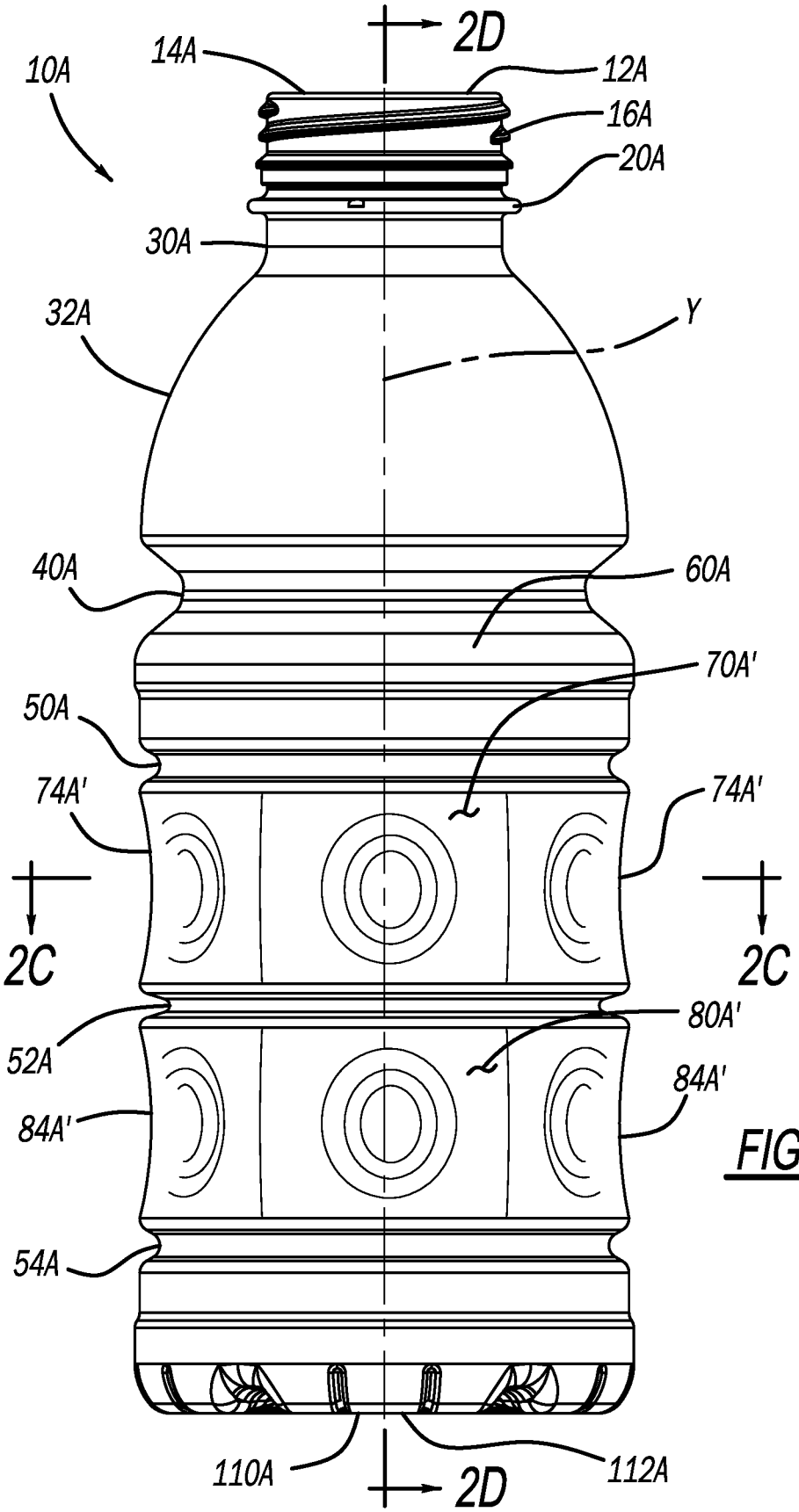
FIG. 2A is a side view similar to FIG. 1A of the first polymeric container, but with flexible panels thereof contracted in response to a vacuum within the container as a result of filling and capping the container.
Figure 2B:
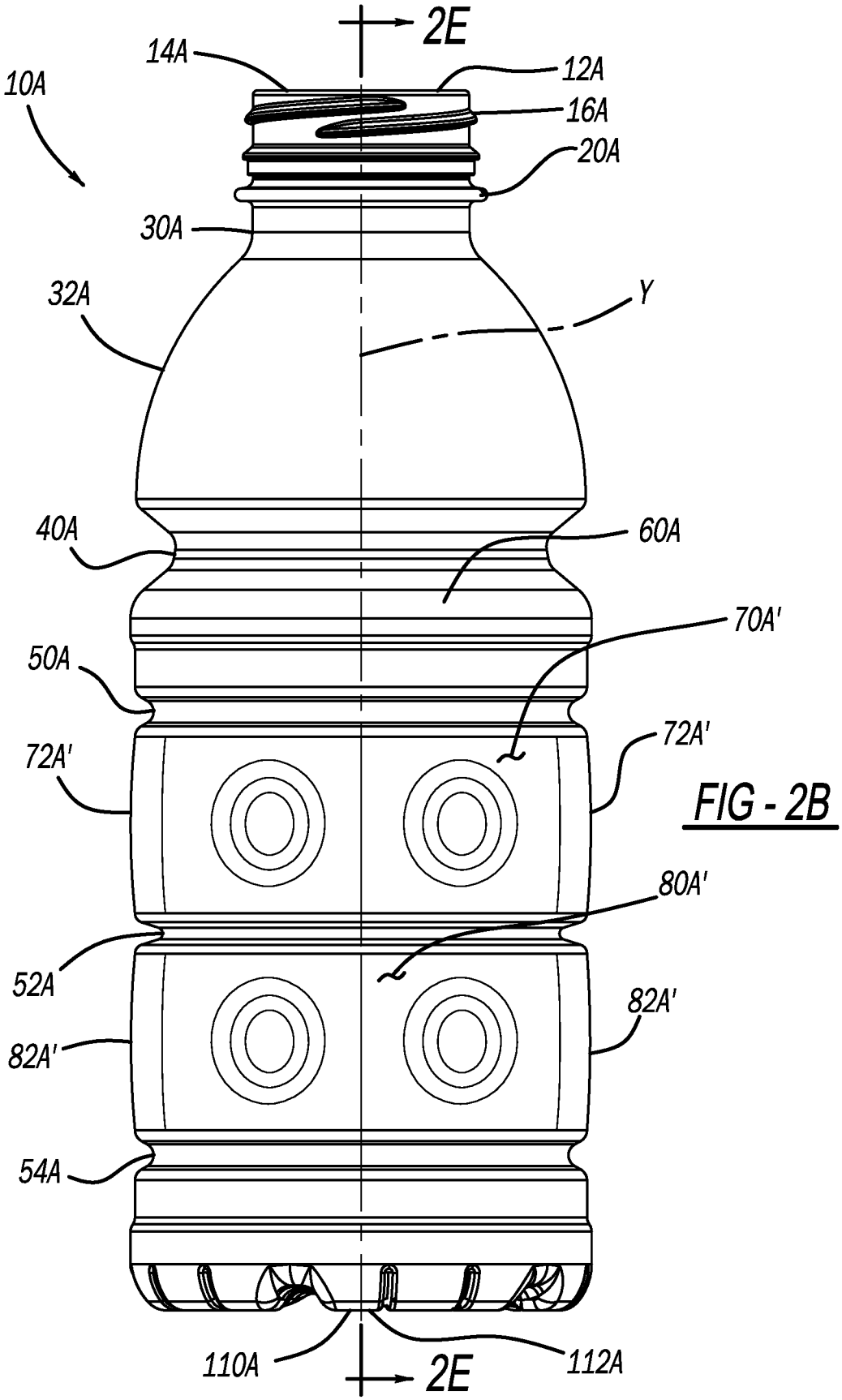
FIG. 2B is another side view of the container with flexible panels thereof contracted.
Figure 2C:
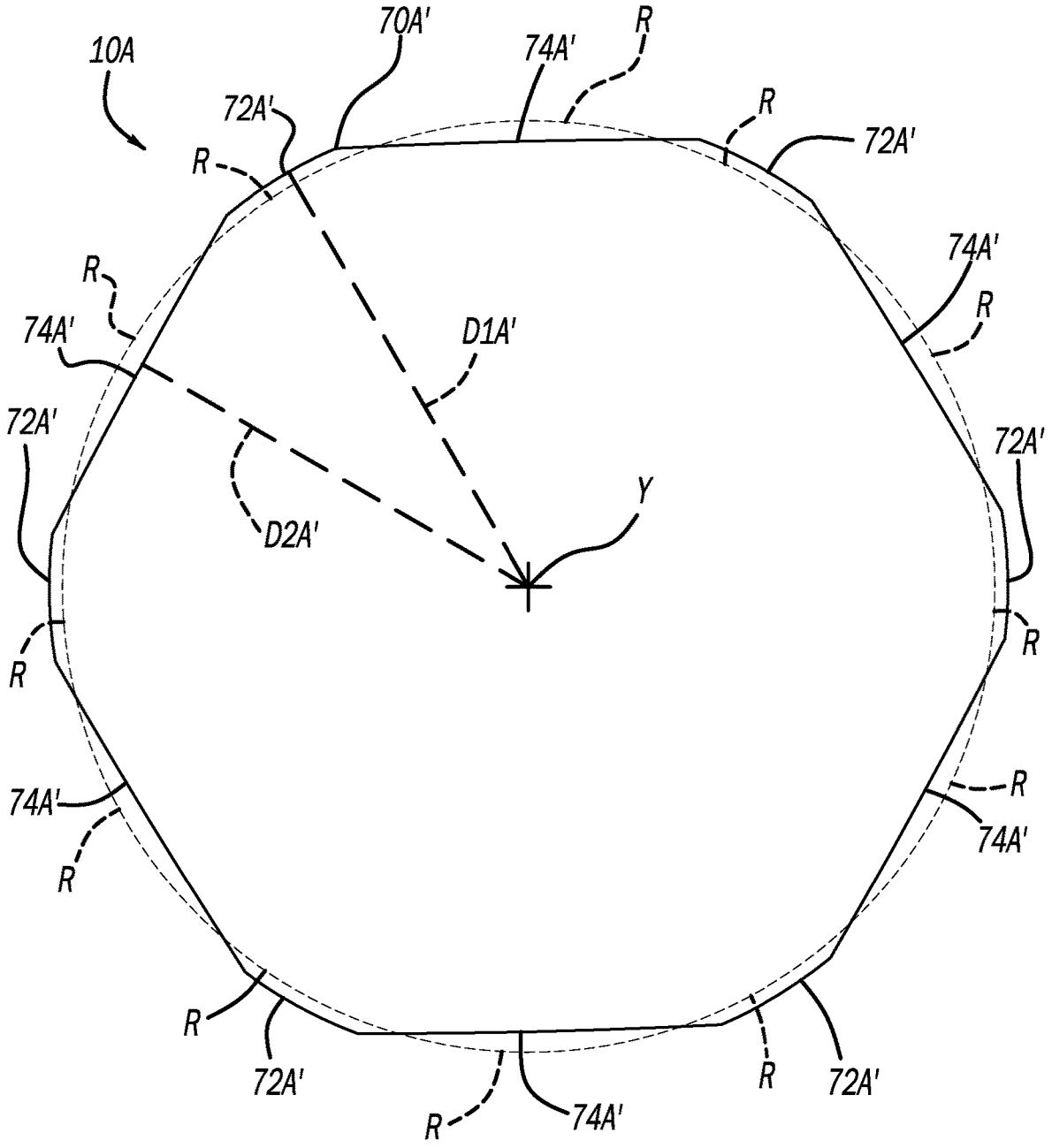
FIG. 2C is a cross-sectional view taken along line 2C-2C of FIG. 2A.
Figure 2D:
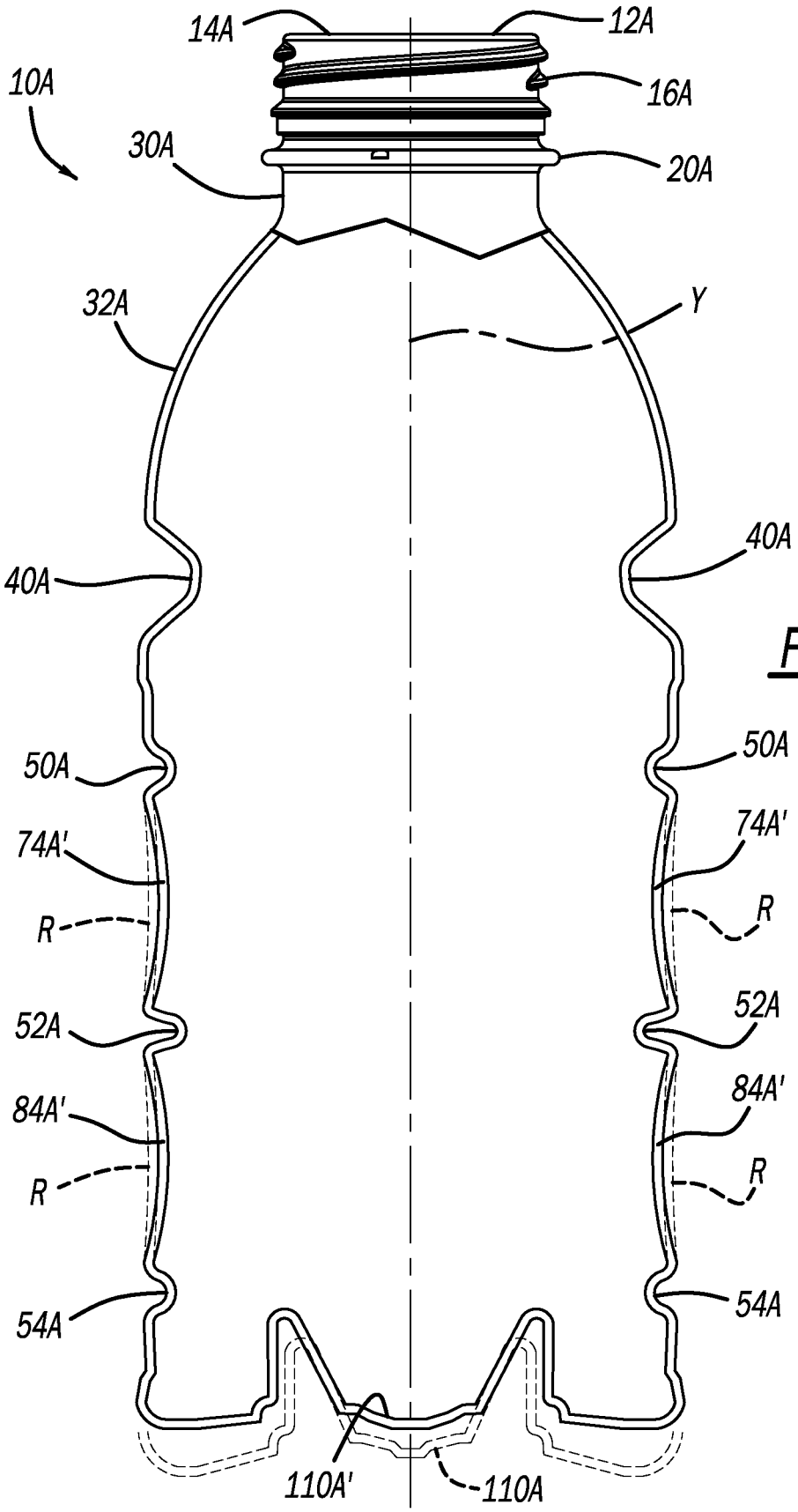
FIG. 2D is a cross-sectional view taken along line 2D-2D of FIG. 2A.
Figure 2E:
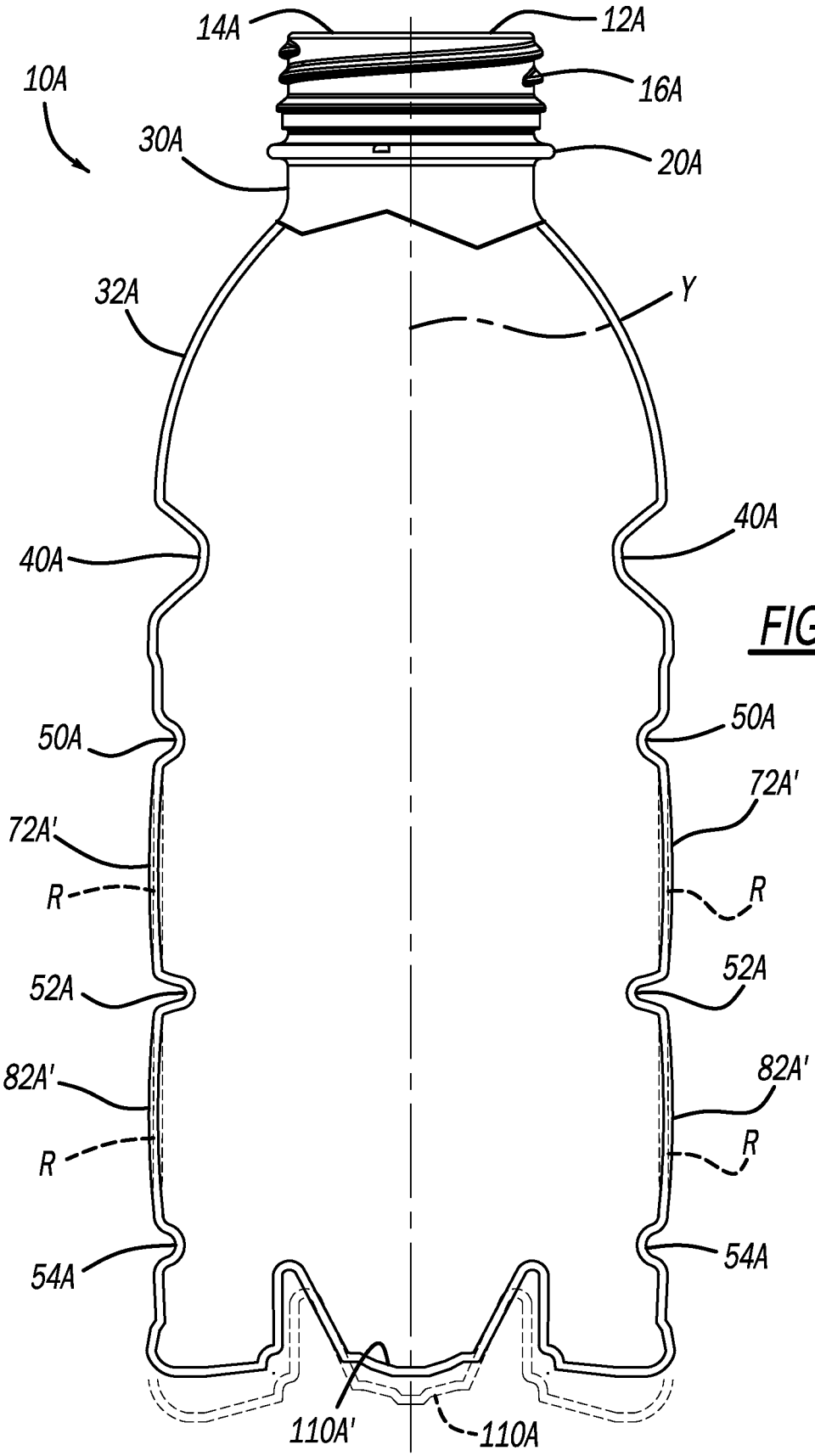
FIG. 2E is a cross-sectional view taken along line 2E-2E of FIG. 2B.
Figure 3A:
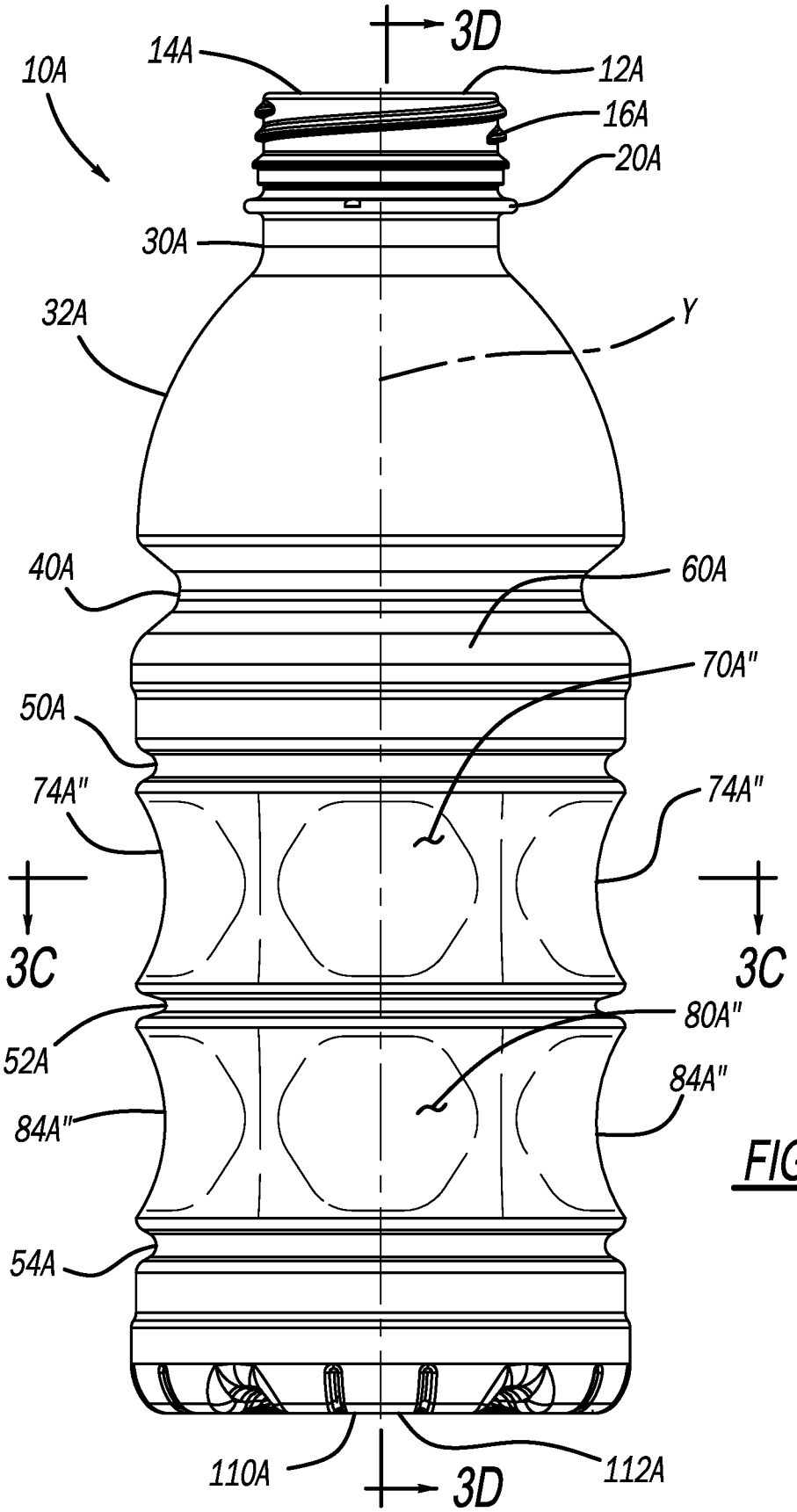
FIG. 3A is a side view similar to FIG. 1A of the first polymeric container, but with flexible panels thereof further contracted in response to additional vacuum within the container as a result of filling and capping the container.
Figure 3B:
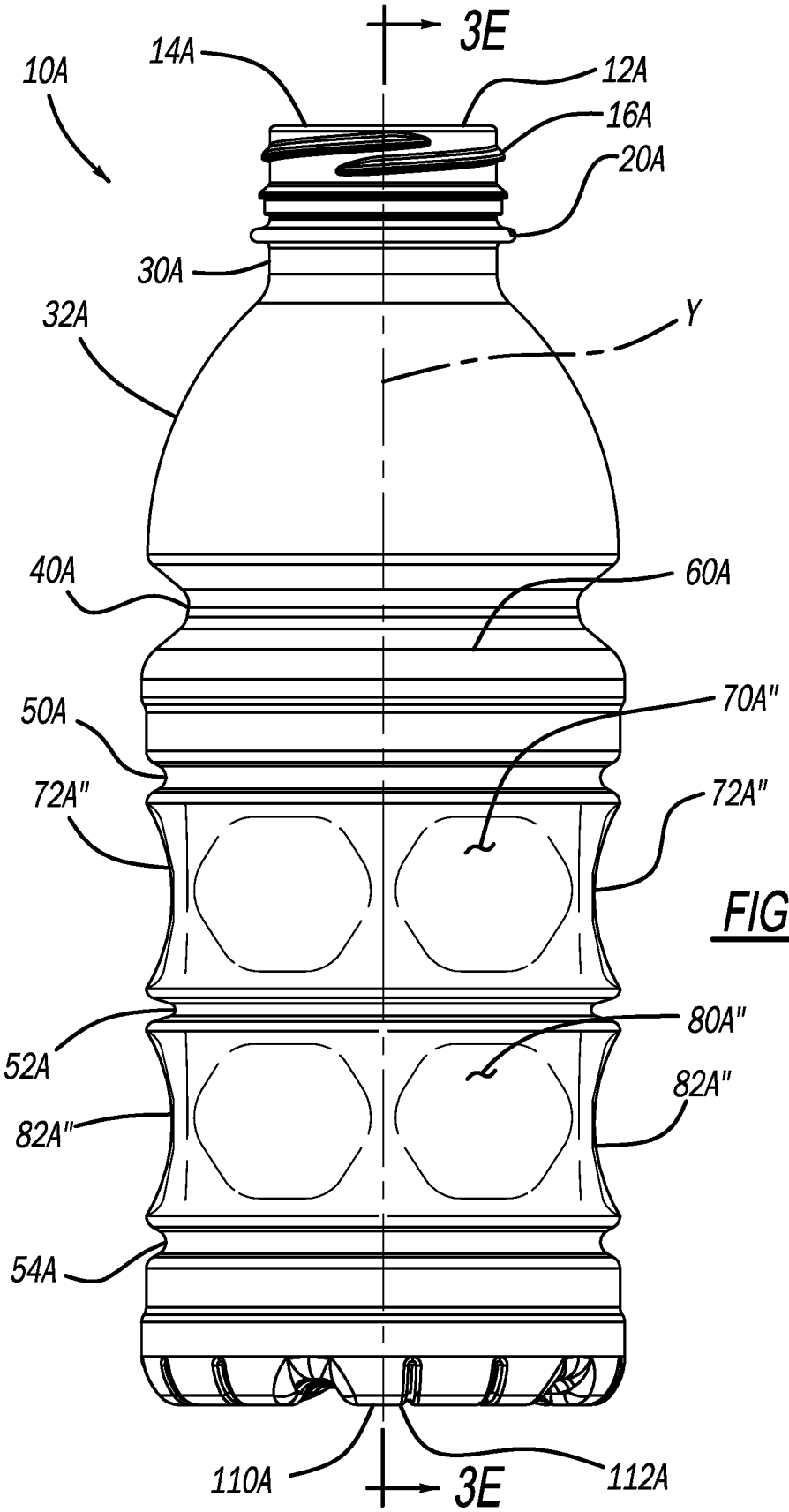
FIG. 3B is another side view of the container with the flexible panels thereof further contracted.
Figure 3C:
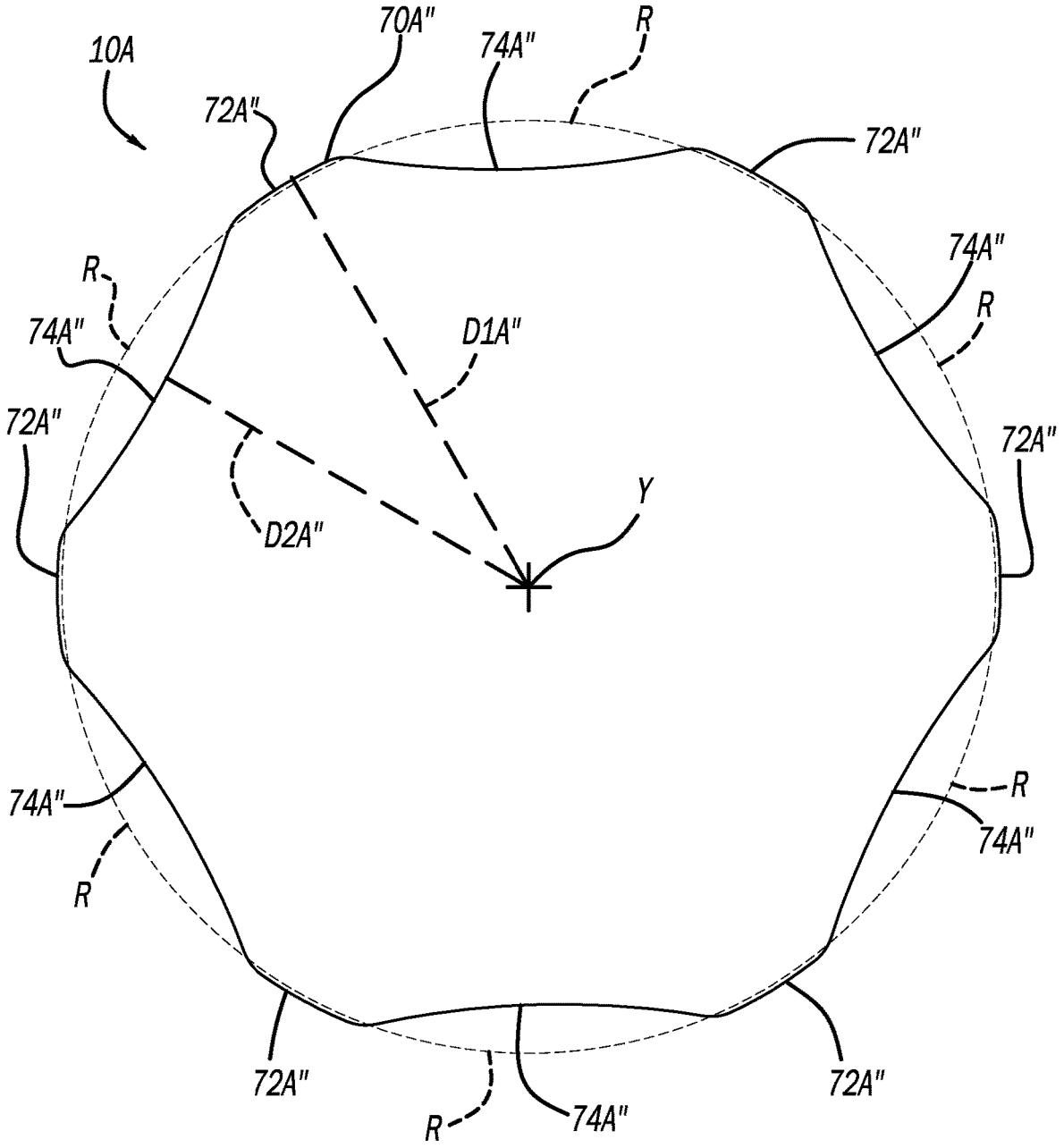
FIG. 3C is a cross-sectional view taken along line 3C-3C of FIG. 3A.
Figure 3D:
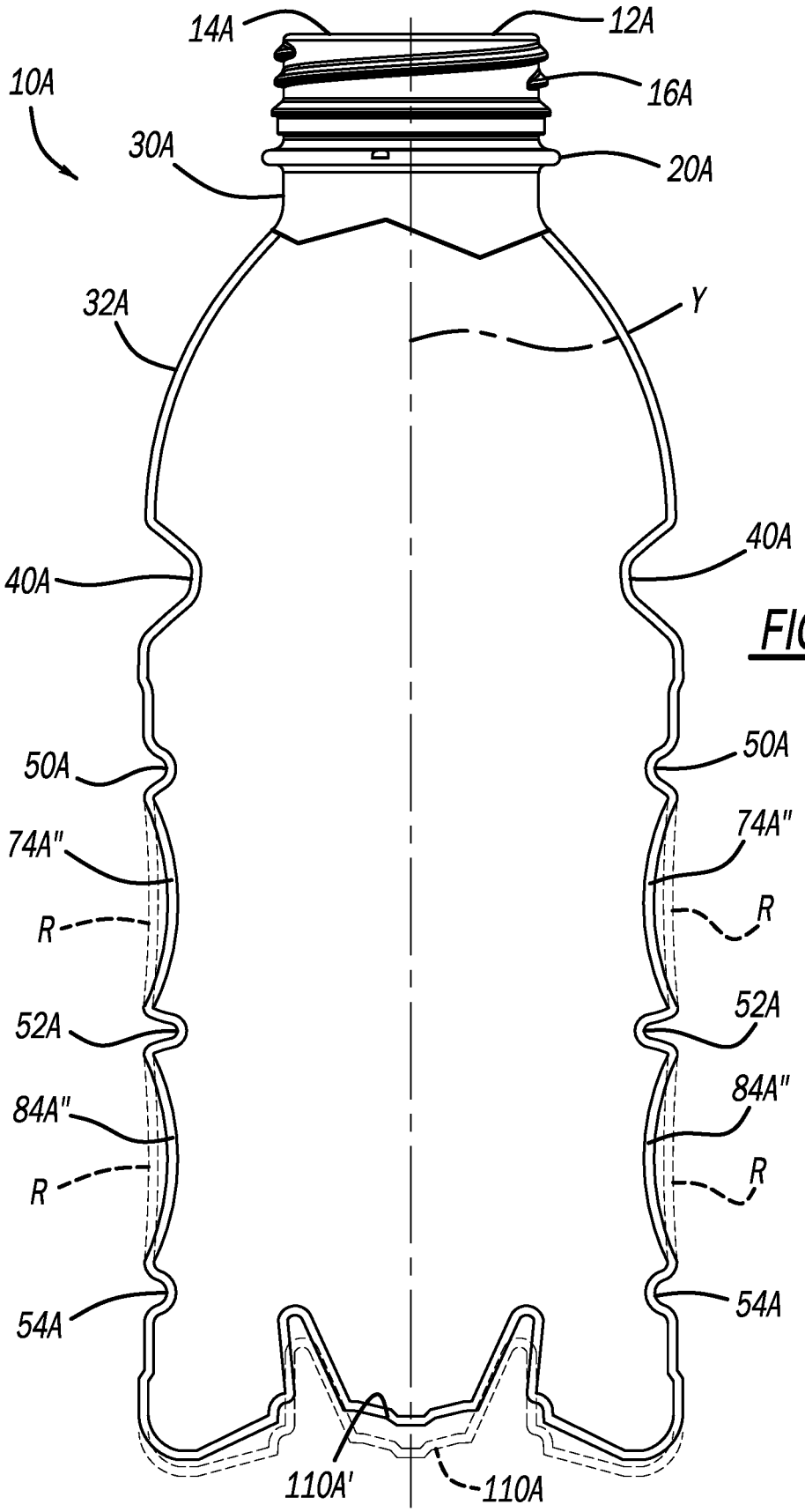
FIG. 3D is a cross-sectional view taken along line 3D-3D of FIG. 3A.
Figure 3E:
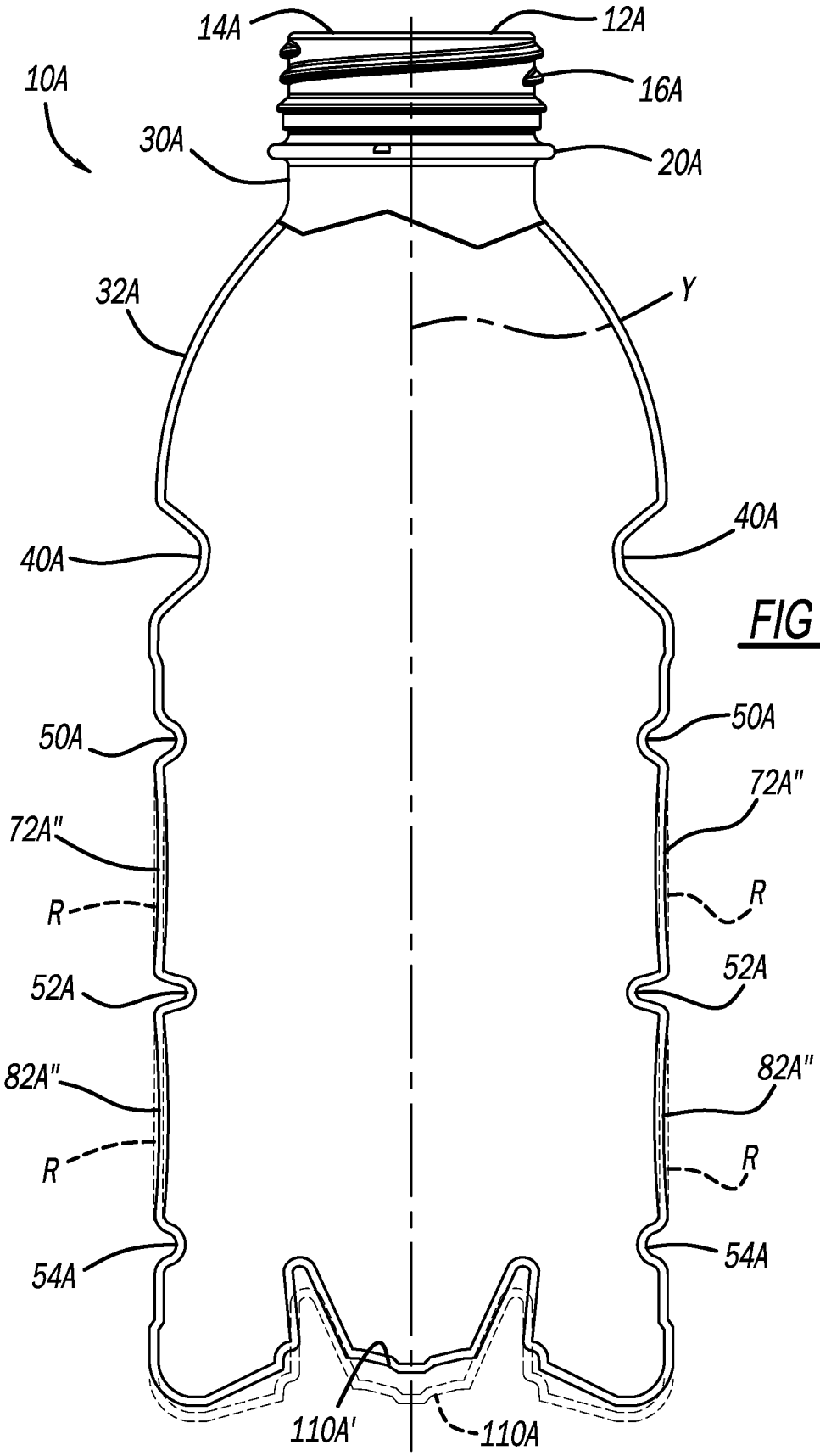
FIG. 3E is a cross-sectional view taken along line 3E-3E of FIG. 3B.

The concave portions 74A and 84A are configured to flex inwards towards the axial center and longitudinal axis y in response to a vacuum within the container 10A resulting from filling and capping the container 10A. For example and as illustrated in FIGS. 2A-2E, the concave portions 74A and 84A flex inwards and become more concave at 74A' and 84A'. The inwardly flexed concave portions 74A' and 84A' assume a generally round shape. In response to the vacuum, the vertically extending columns 72A flex outward and become convex at 72A'. With reference to FIGS. 2C-2E in particular, the vertically extending columns flex outward to 72A' such that distance D1A' is greater than D1A. The concave portions flex inward to 74A' such that distance D2A' is less than D2A. Also, the base 110A flexes inward to 110A' to absorb the vacuum, as illustrated in FIGS. 2D and 2E.

As the vacuum within the container 10A increases, the concave portions 74A' and 84A' flex further inward towards the longitudinal axis y to positions 74A" and 84A" illustrated in FIGS. 3A-3E. Under this further increased vacuum, the concave portions 74A" and 84A" are configured to assume a generally hexagonal shape. Under this further increased vacuum, the vertically extending columns move to 72A" and 82A". Distance D1A" from the longitudinal axis y to the vertically extending columns 72A" (and to columns 82A") is less than distance D1A'. Distance D2A" from the longitudinal axis y to the concave portions 74A" (and to concave portions 84A") is less than distance D2A'.

Figure 4:
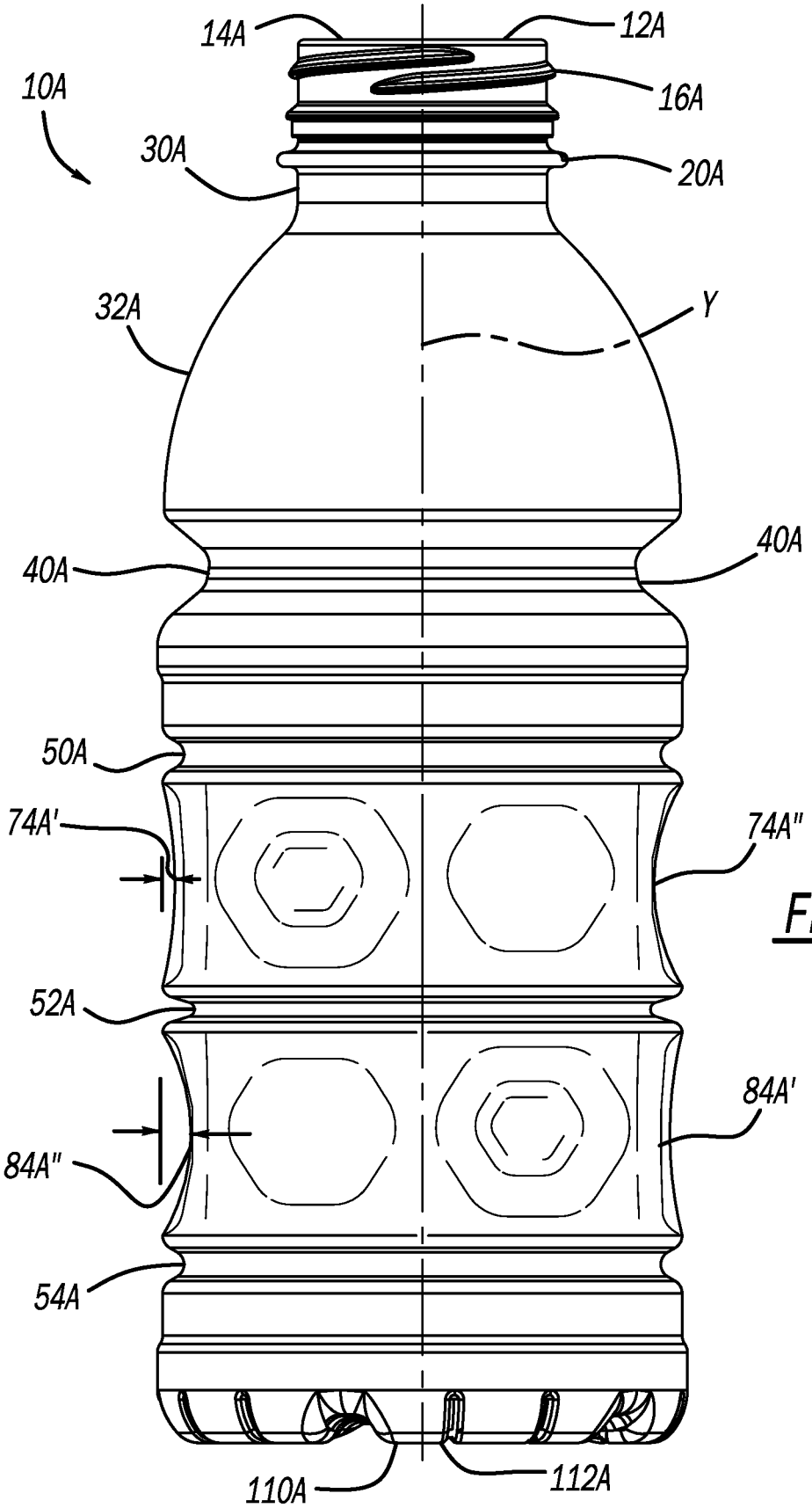
FIG. 4 is a side view of the first polymeric container configured with vertically aligned flexible panels that contract at different rates in response to a vacuum within the container as a result of filling and capping the container.
Figure 5:
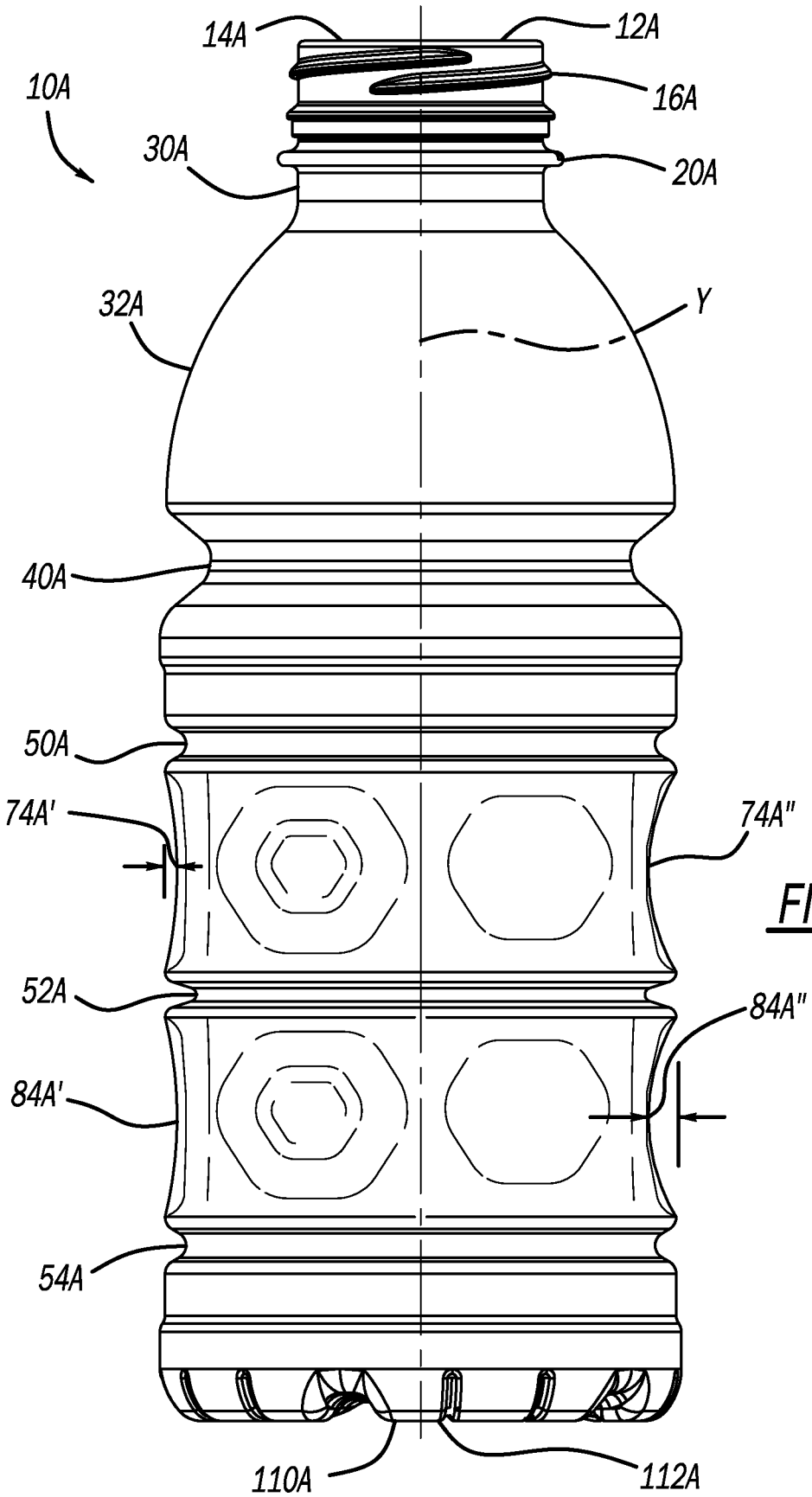
FIG. 5 is a side view of the first polymeric container configured with vertically offset flexible panels that contract at different rates in response to a vacuum within the container as a result of filling and capping the container.
Figure 6A:
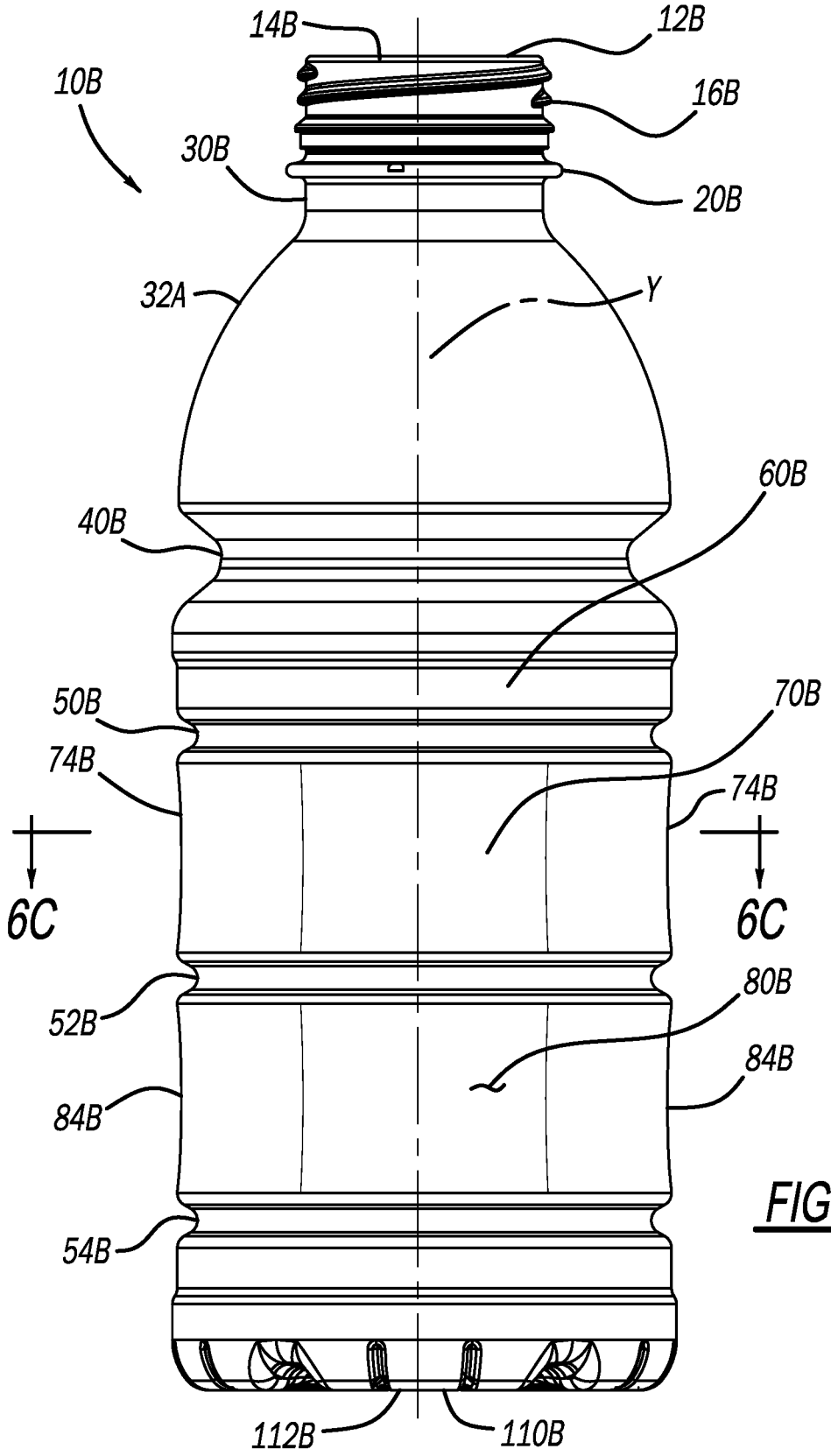
FIG. 6A is a side view of a second polymeric container in accordance with the present disclosure, the second polymeric container is in an as-blown, pre-filled configuration.
Figure 6B:
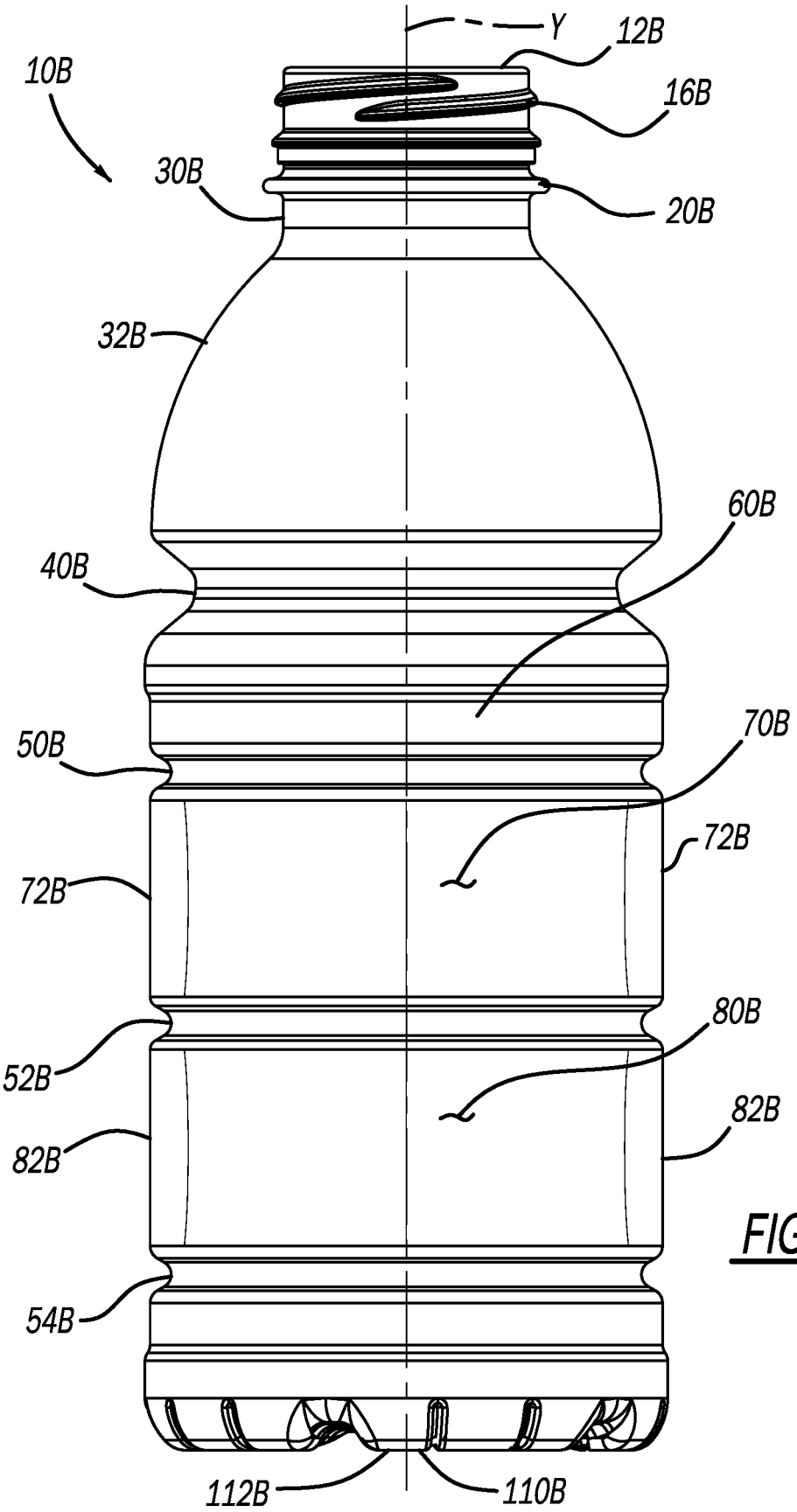
FIG. 6B is another side view of the second container of FIG. 6A.
Figure 6C:
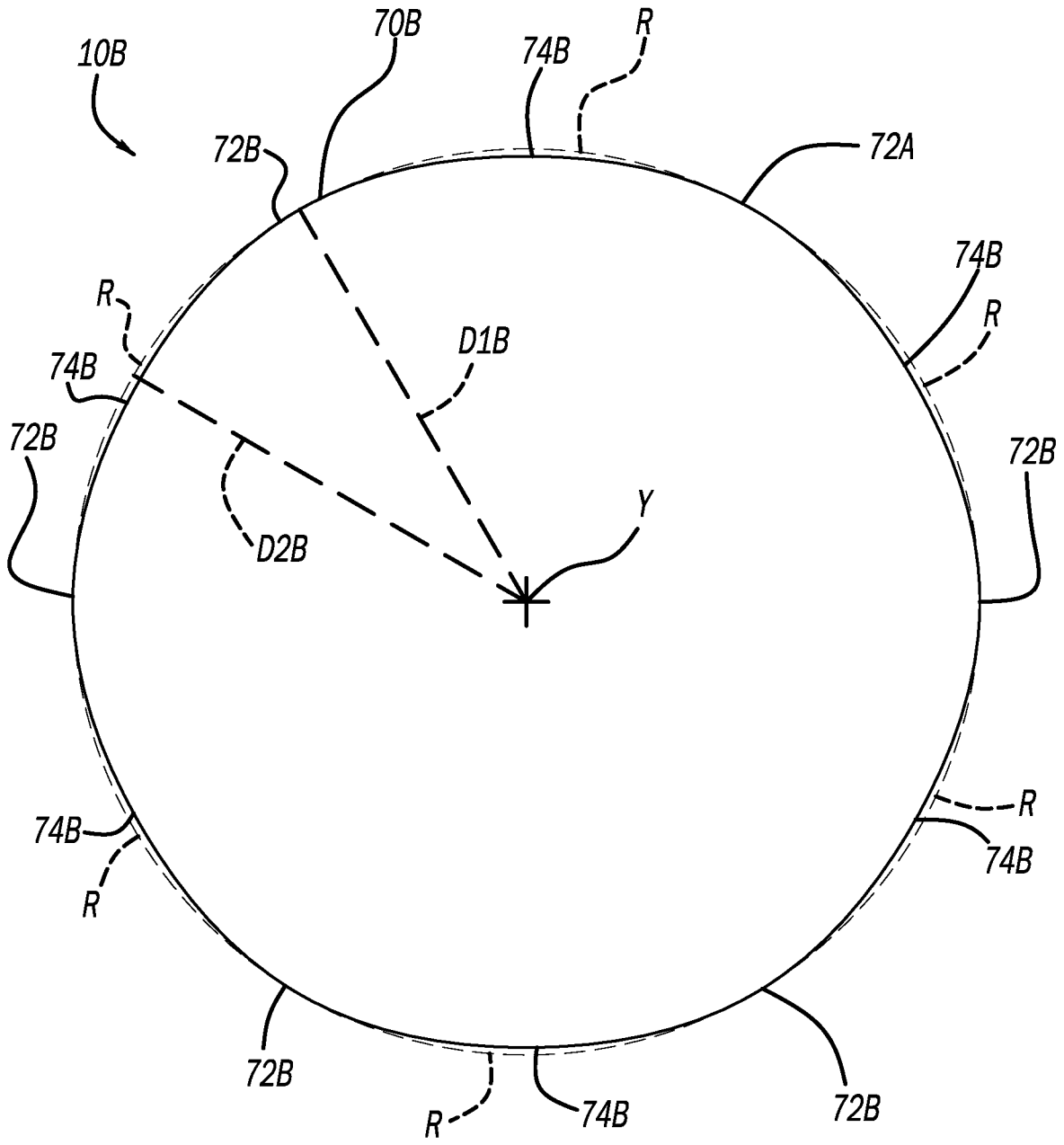
FIG. 6C is a cross-sectional view taken along line 6C-6C of FIG. 6A.
Figure 7A:
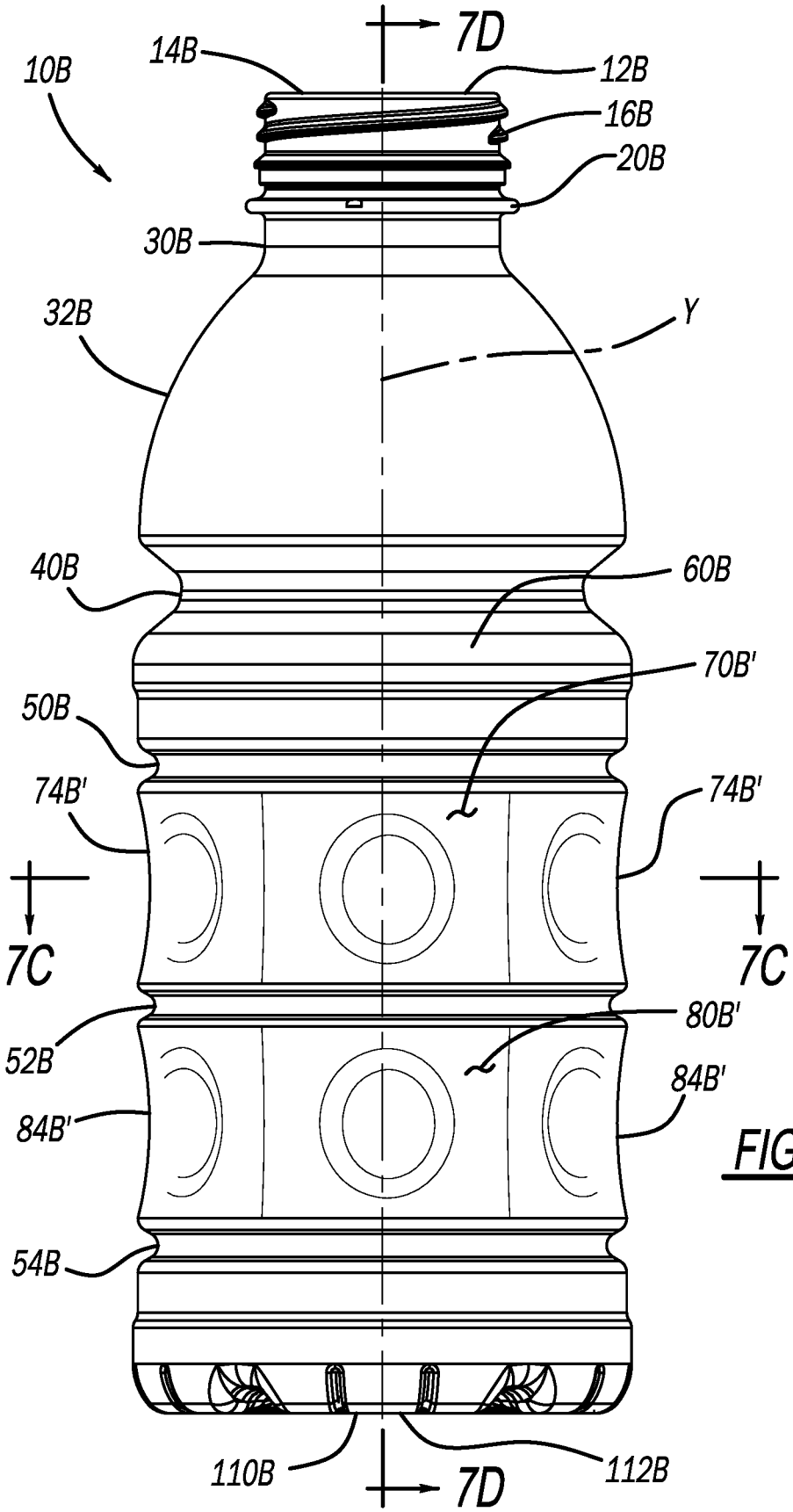
FIG. 7A is a side view similar to FIG. 6A of the second polymeric container, but with flexible panels thereof contracted in response to a vacuum within the container as a result of filling and capping the container.
Figure 7B:
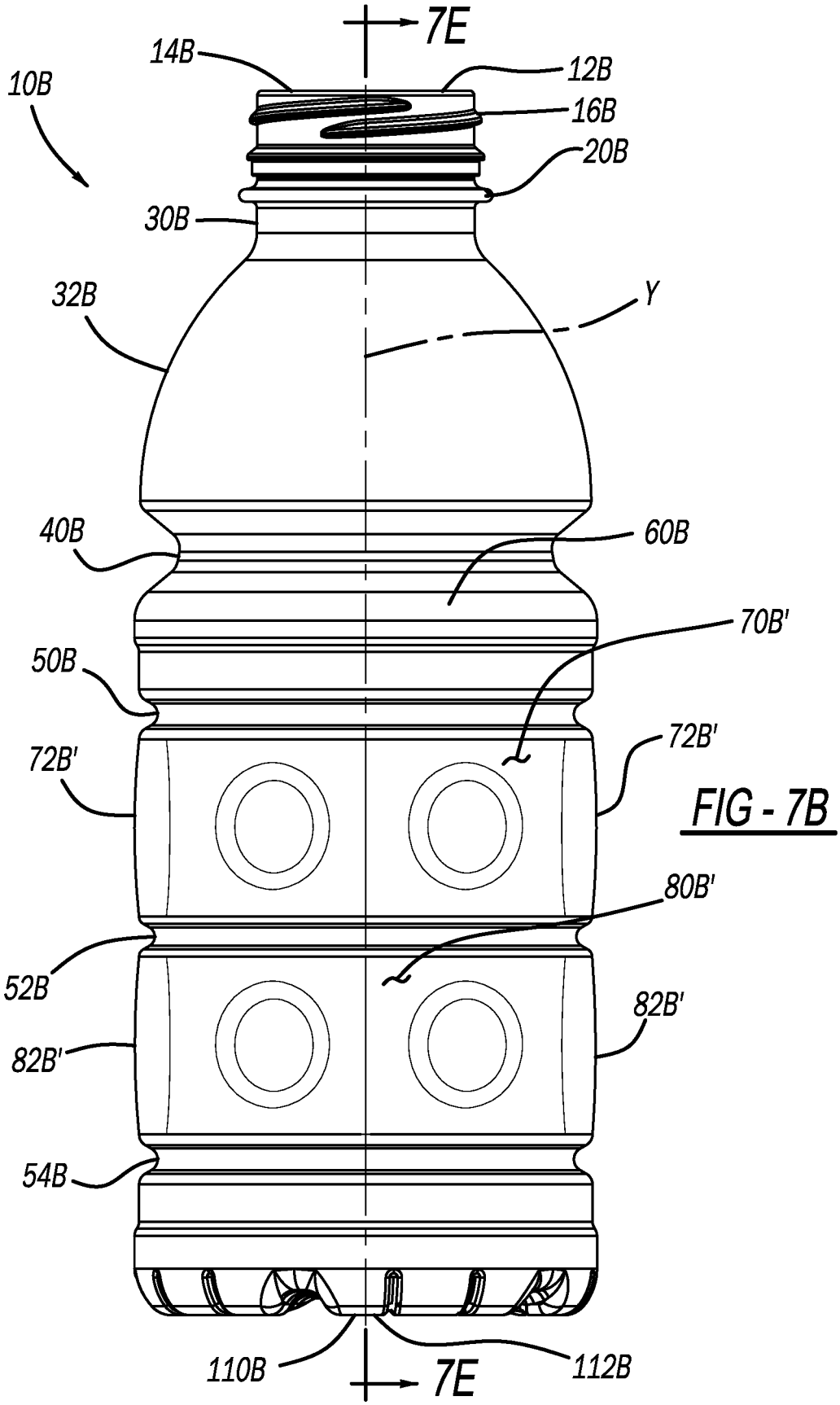
FIG. 7B is another side view of the second container with flexible panels thereof contracted.
Figure 7C:
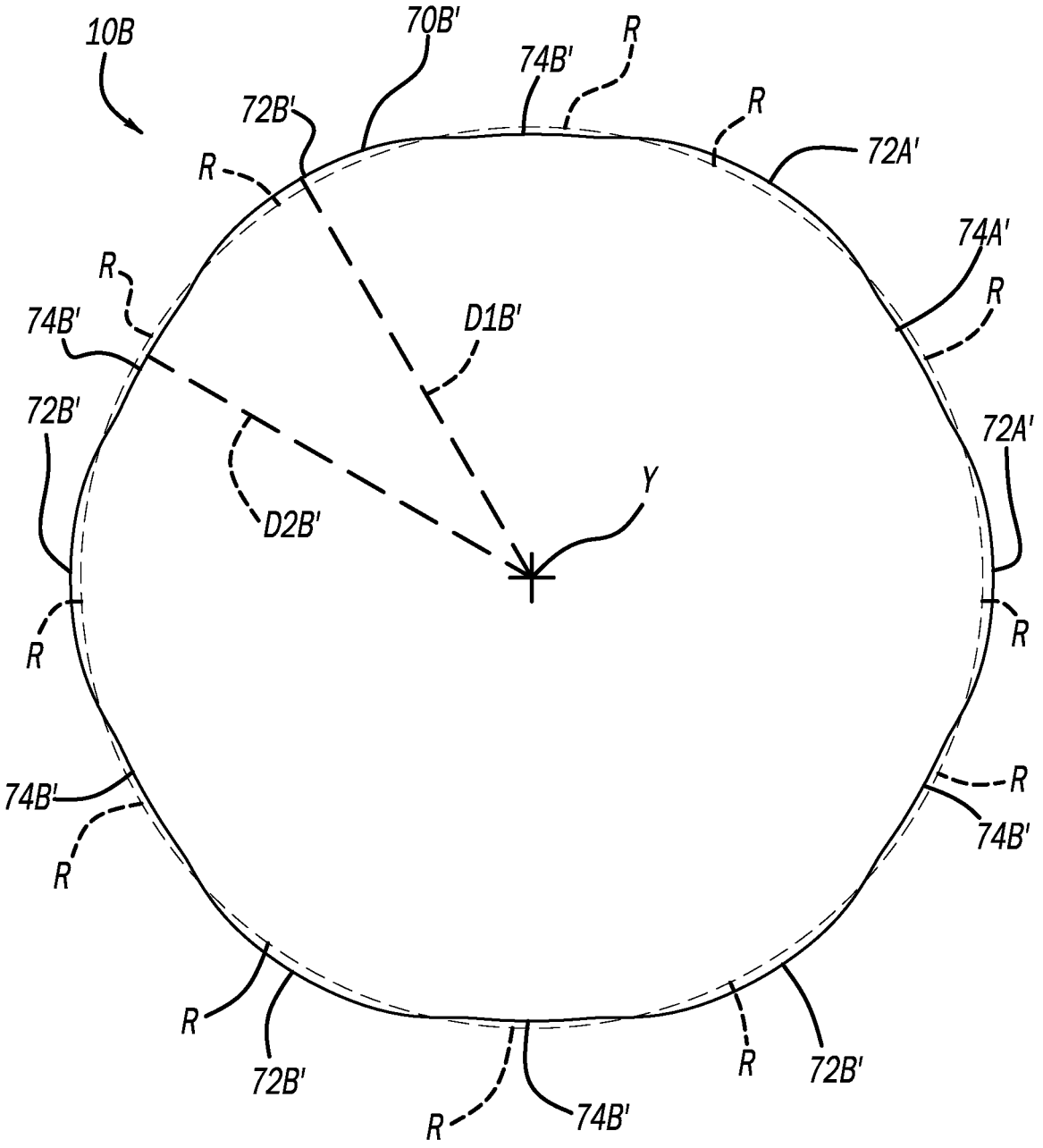
FIG. 7C is a cross-sectional view taken along line 7C-7C of FIG. 7A.
Figure 7D:
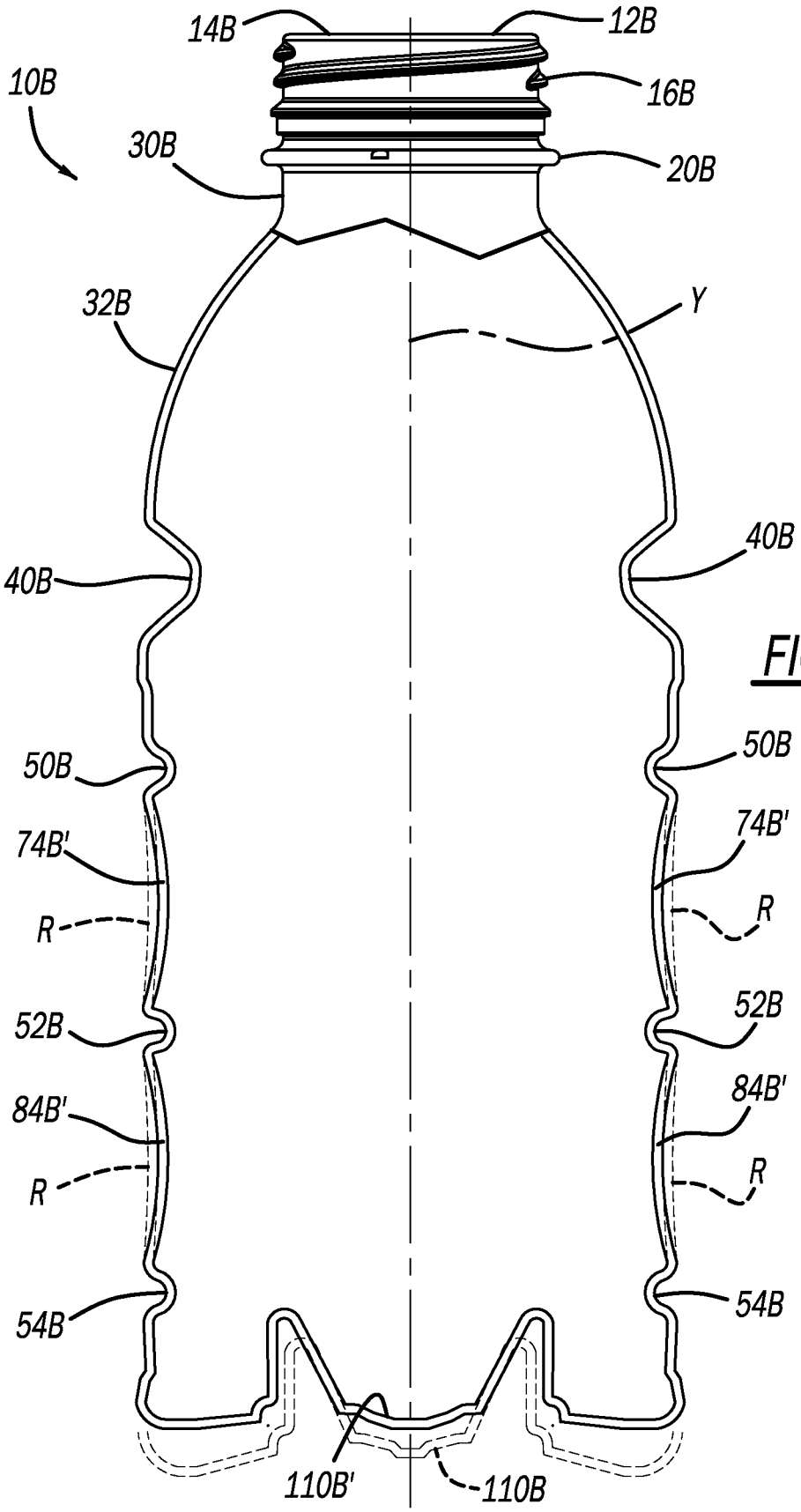
FIG. 7D is a cross-sectional view taken along line 7D-7D of FIG. 7A.
Figure 7E:
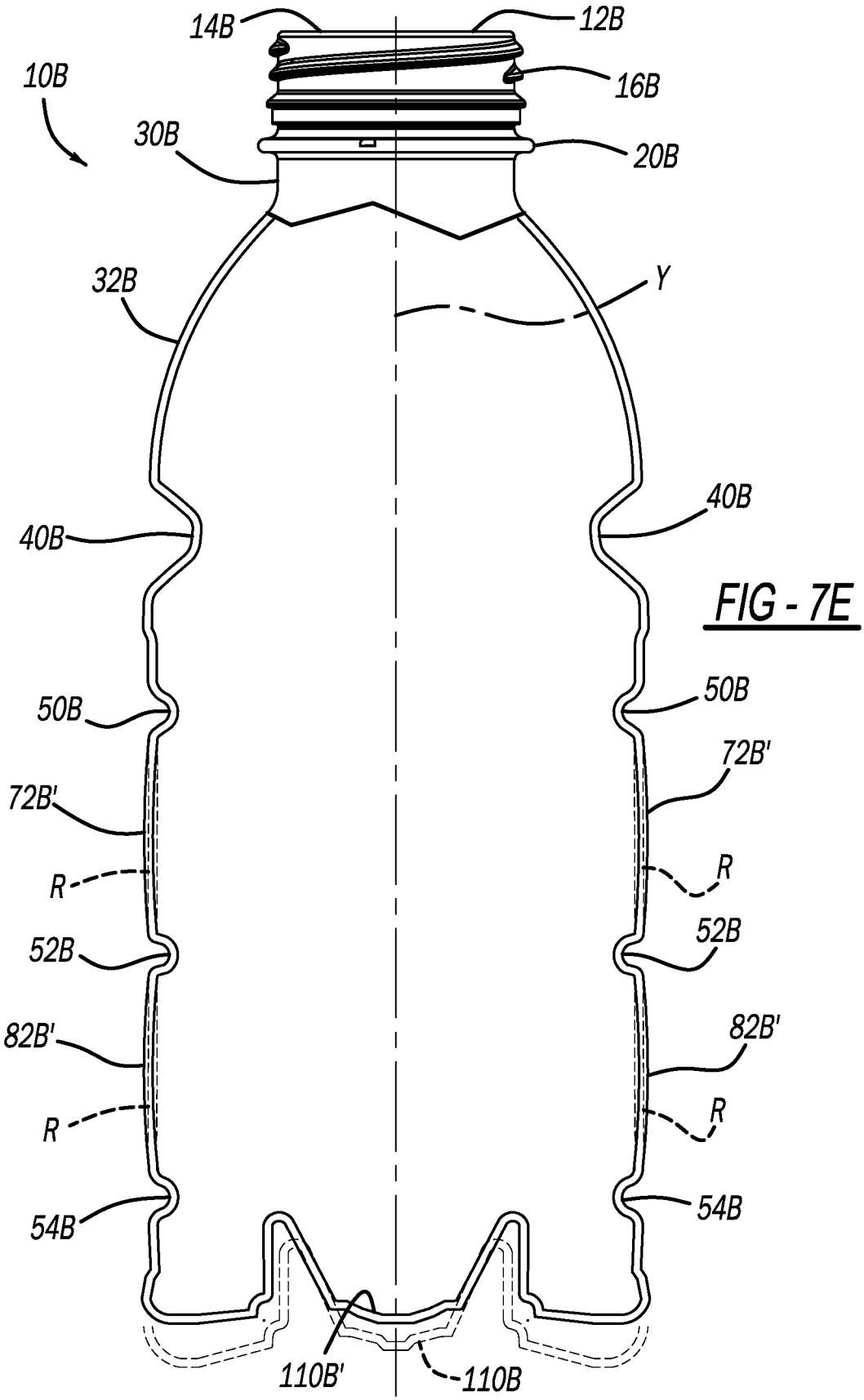
FIG. 7E is a cross-sectional view taken along line 7E-7E of FIG. 7B.
Figure 8A:
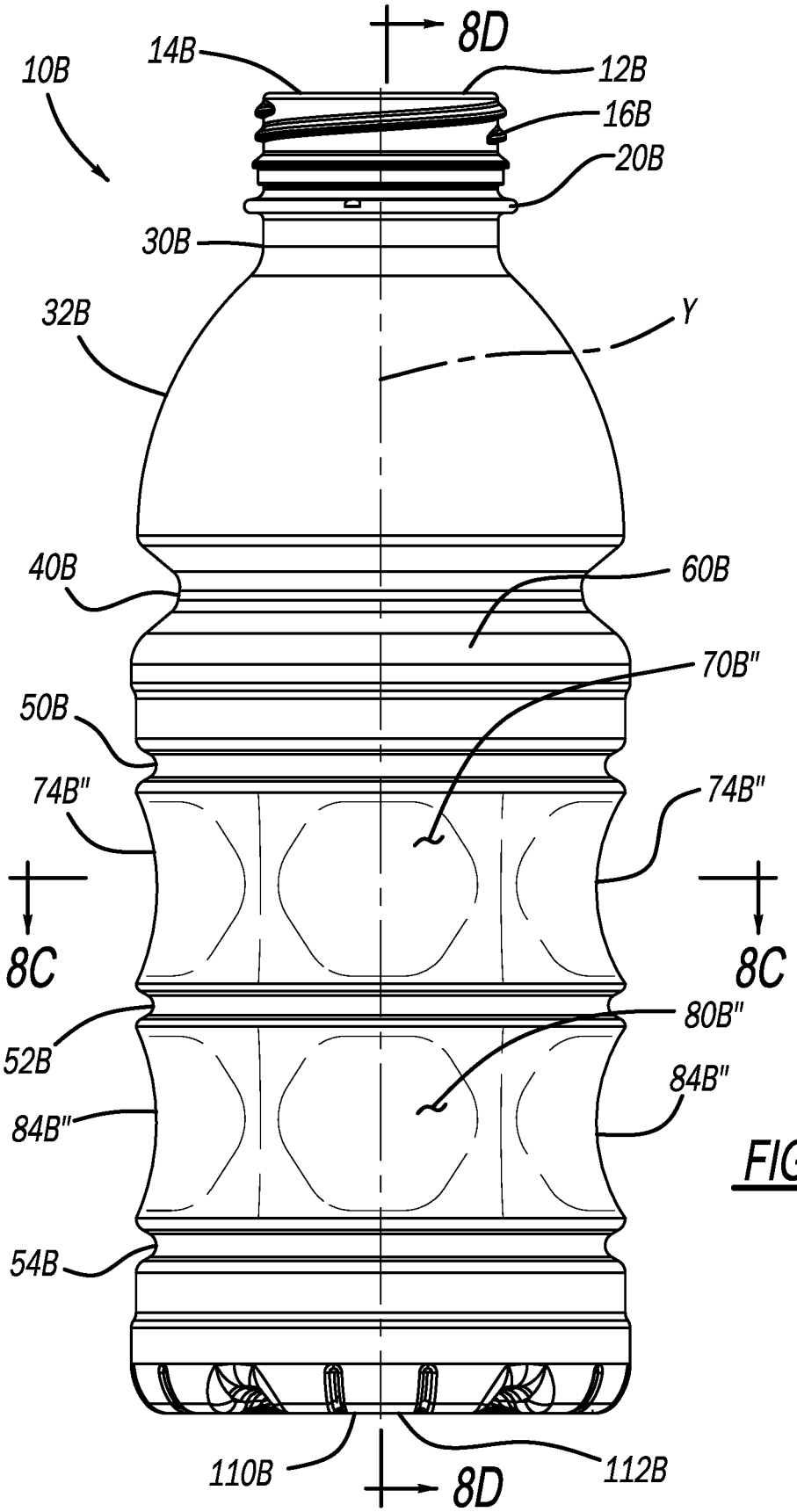
FIG. 8A is a side view similar to FIG. 7A of the second polymeric container, but with flexible panels thereof further contracted in response to additional vacuum within the container as a result of filling and capping the container.
Figure 8B:
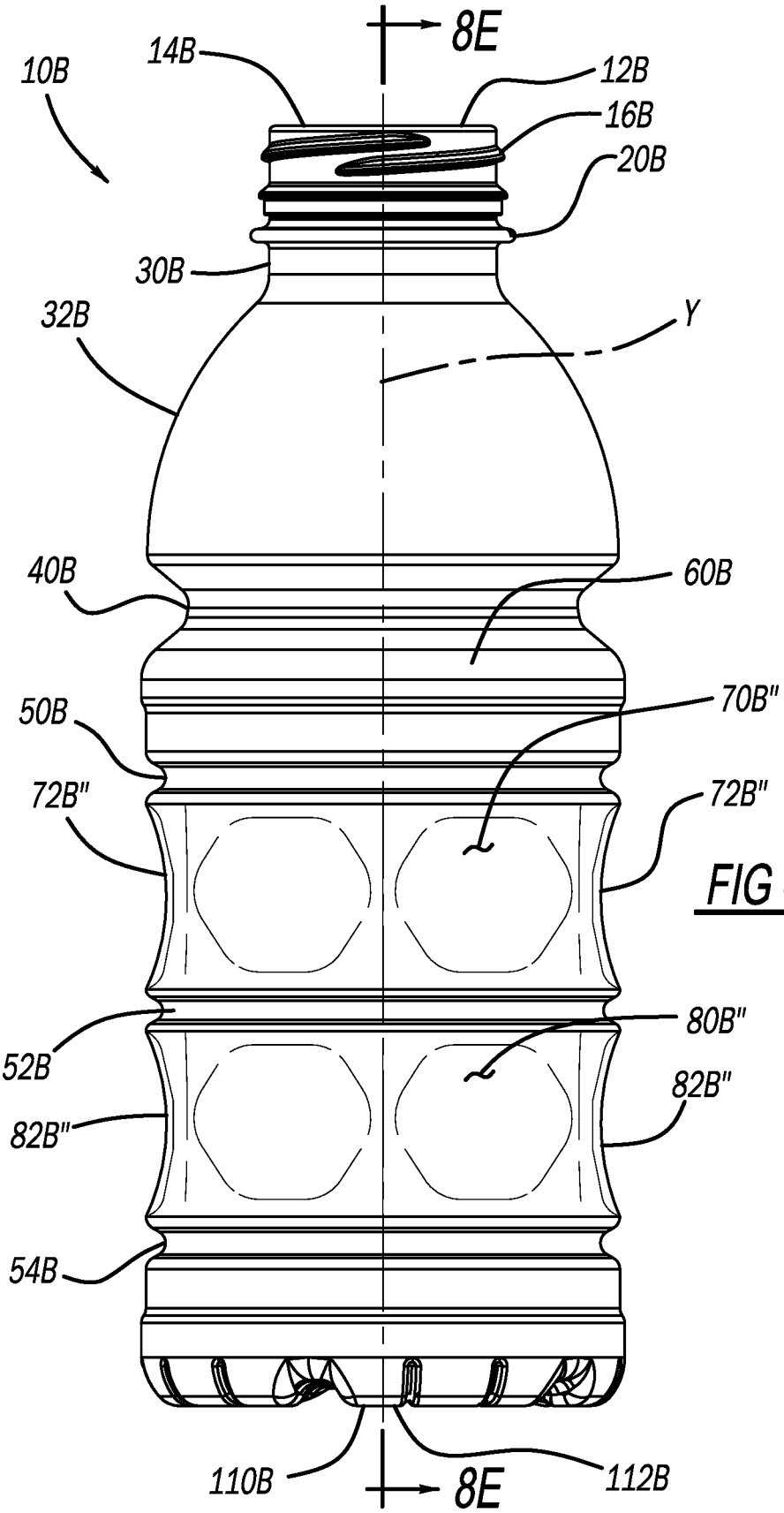
FIG. 8B is another side view of the second container with the flexible panels thereof further contracted.
Figure 8C:
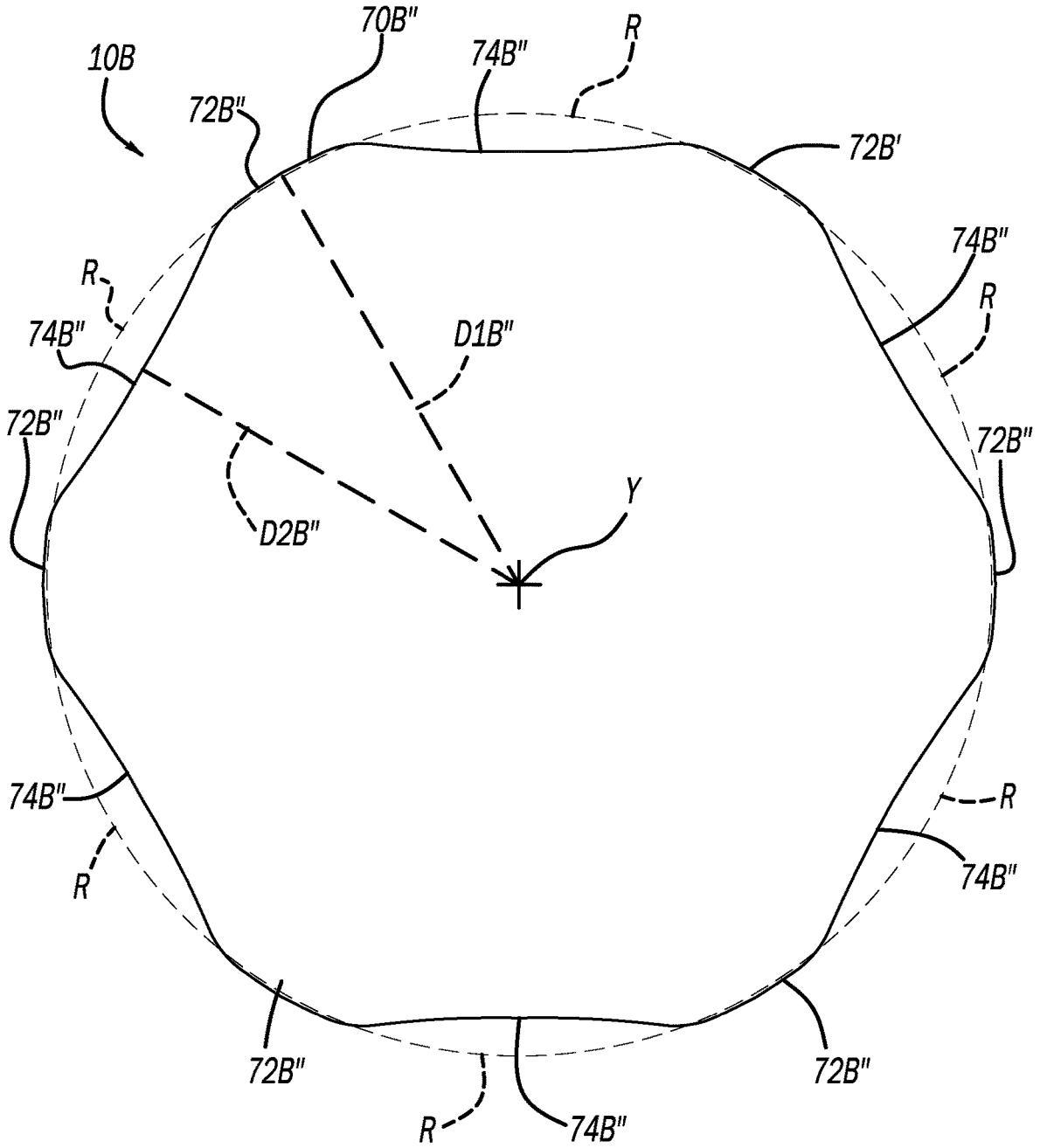
FIG. 8C is a cross-sectional view taken along line 8C-8C of FIG. 8A.
Figure 8D:
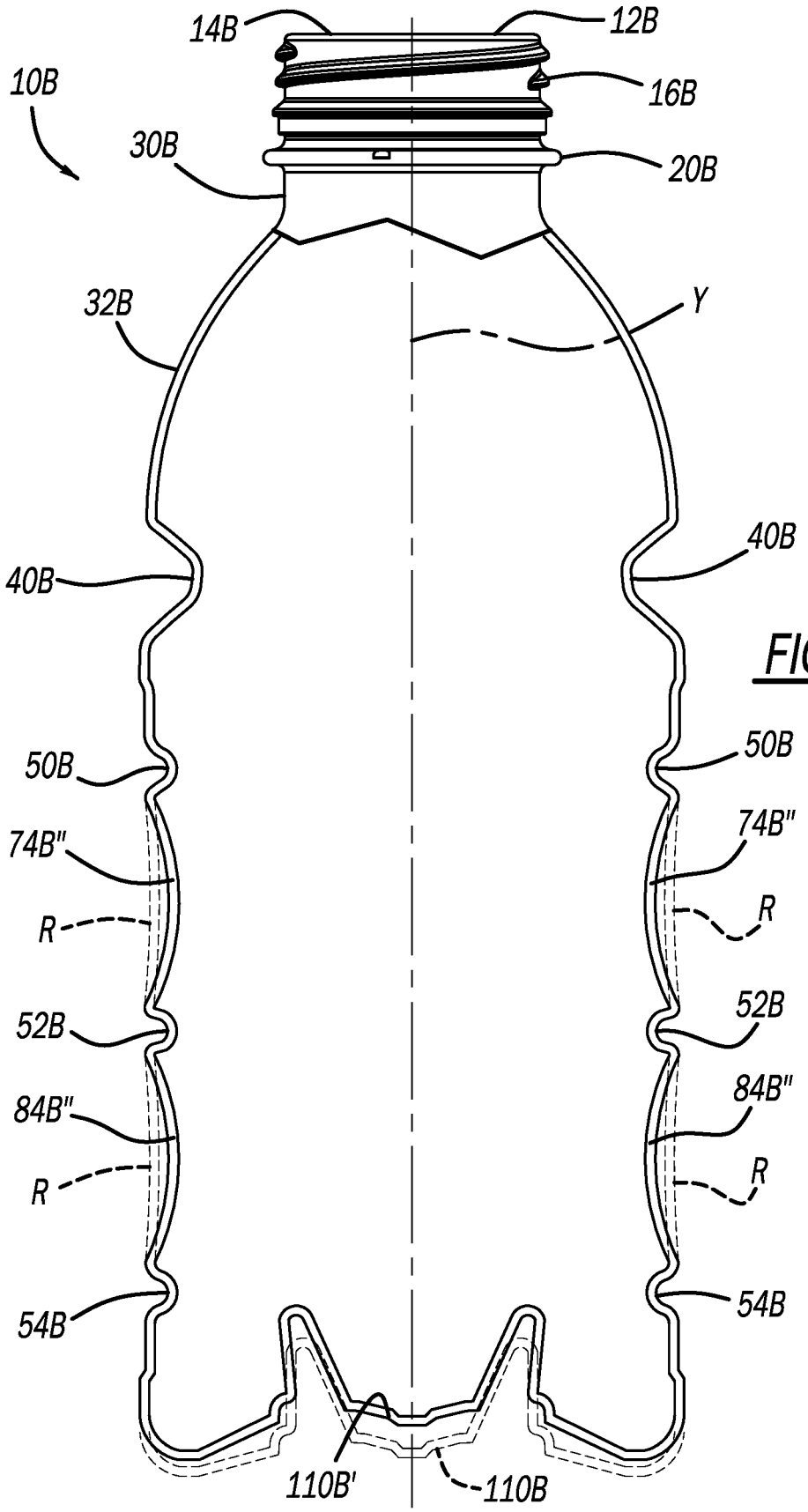
FIG. 8D is a cross-sectional view taken along line 8D-8D of FIG. 8A.
Figure 8E:
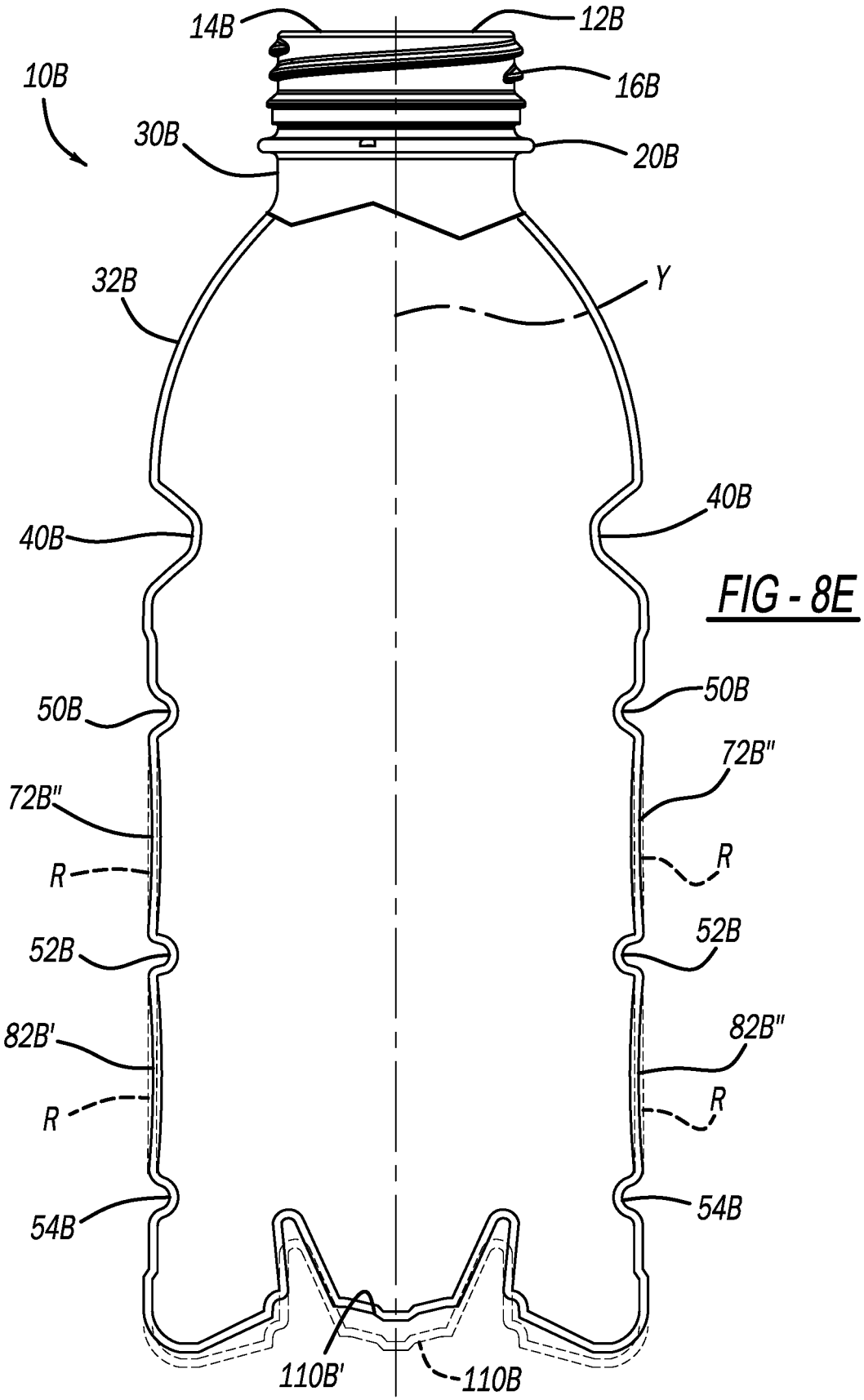
FIG. 8E is a cross-sectional view taken along line 8E-8E of FIG. 8B.
Figure 9:
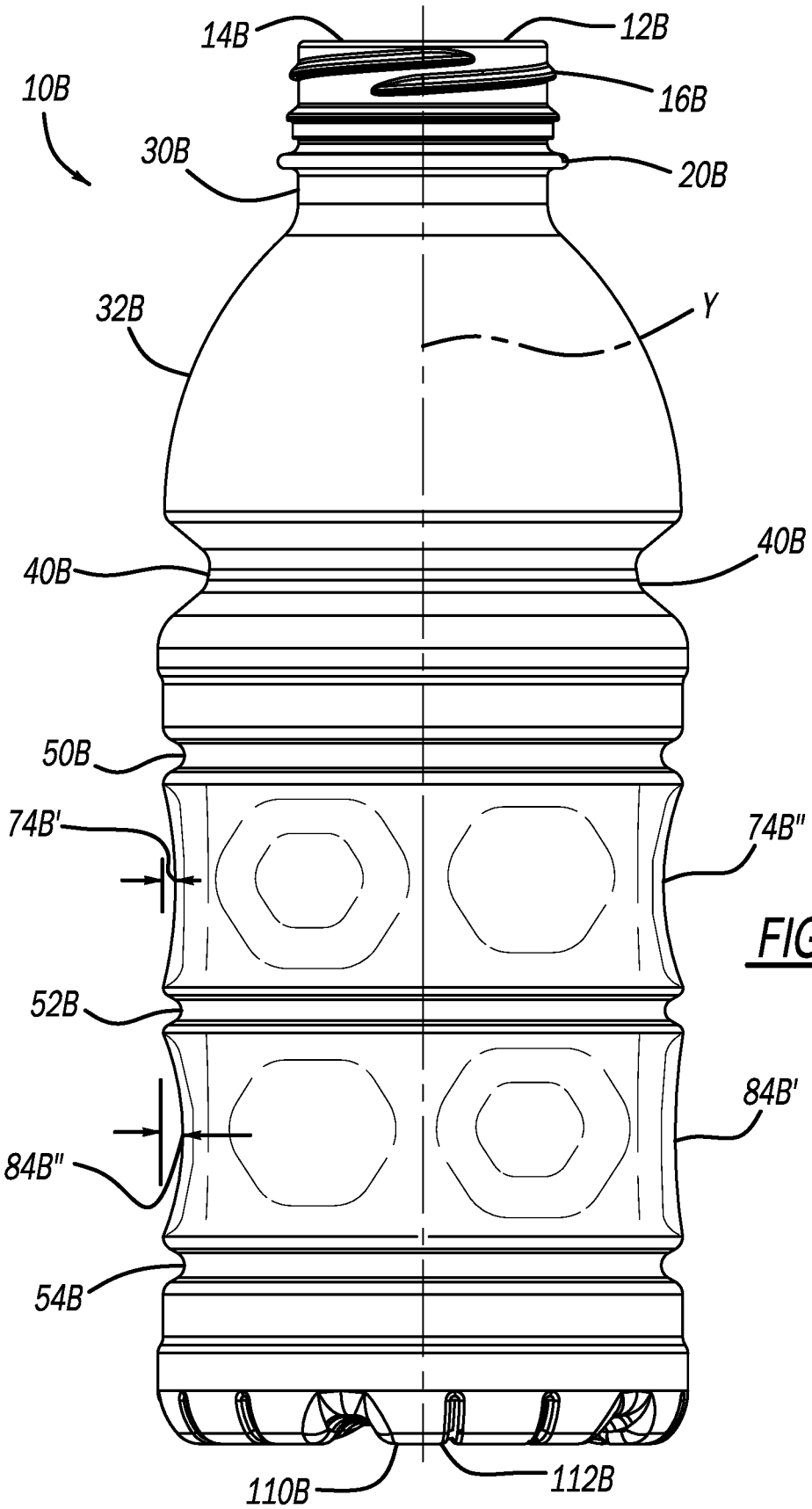
FIG. 9 is a side view of the second polymeric container configured with vertically aligned flexible panels that contract at different rates in response to a vacuum within the container as a result of filling and capping the container.
Figure 10:
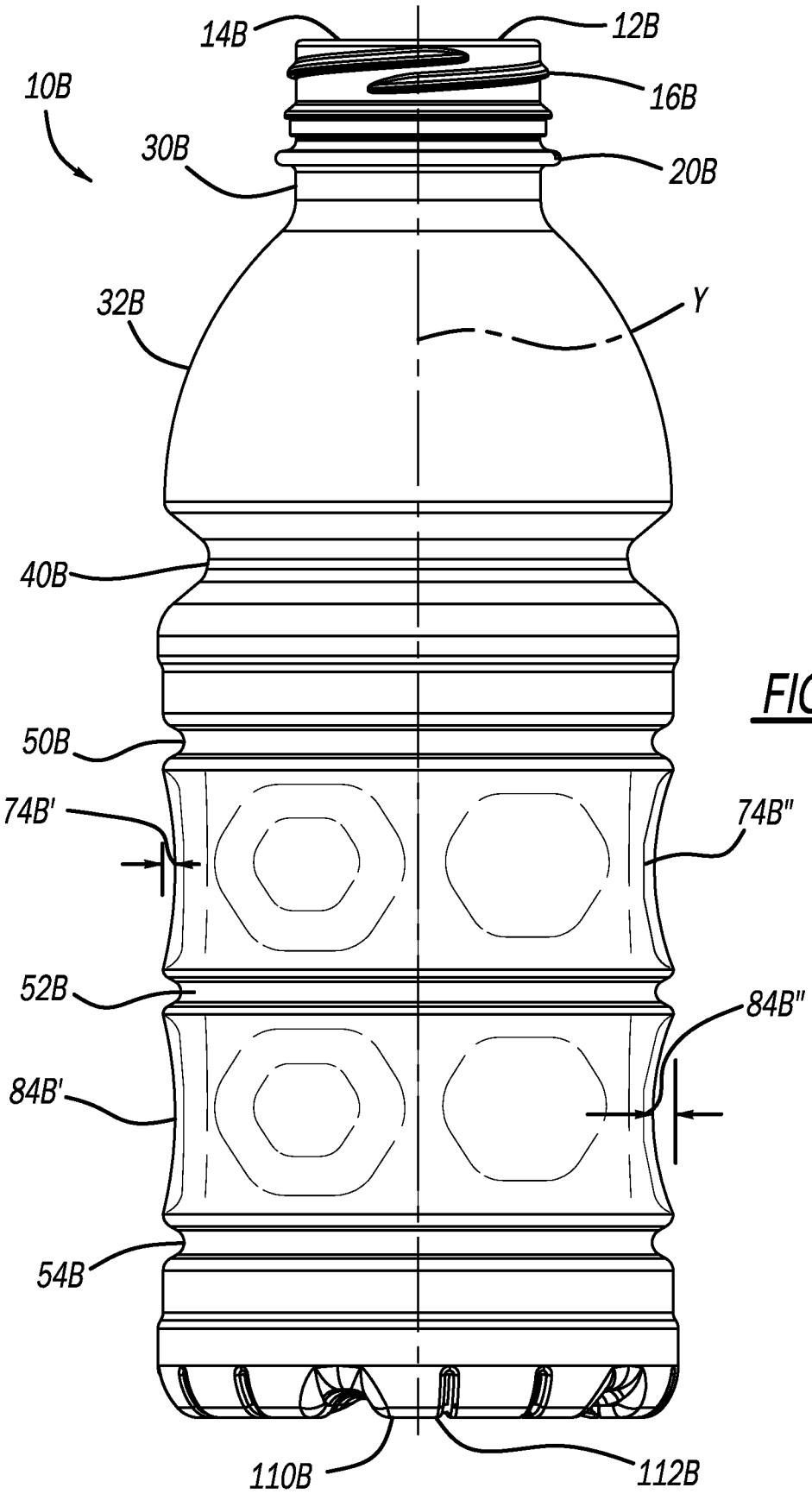
FIG. 10 is a side view of the second polymeric container configured with vertically offset flexible panels that contract at different rates in response to a vacuum within the container as a result of filling and capping the container.
Figure 11A:
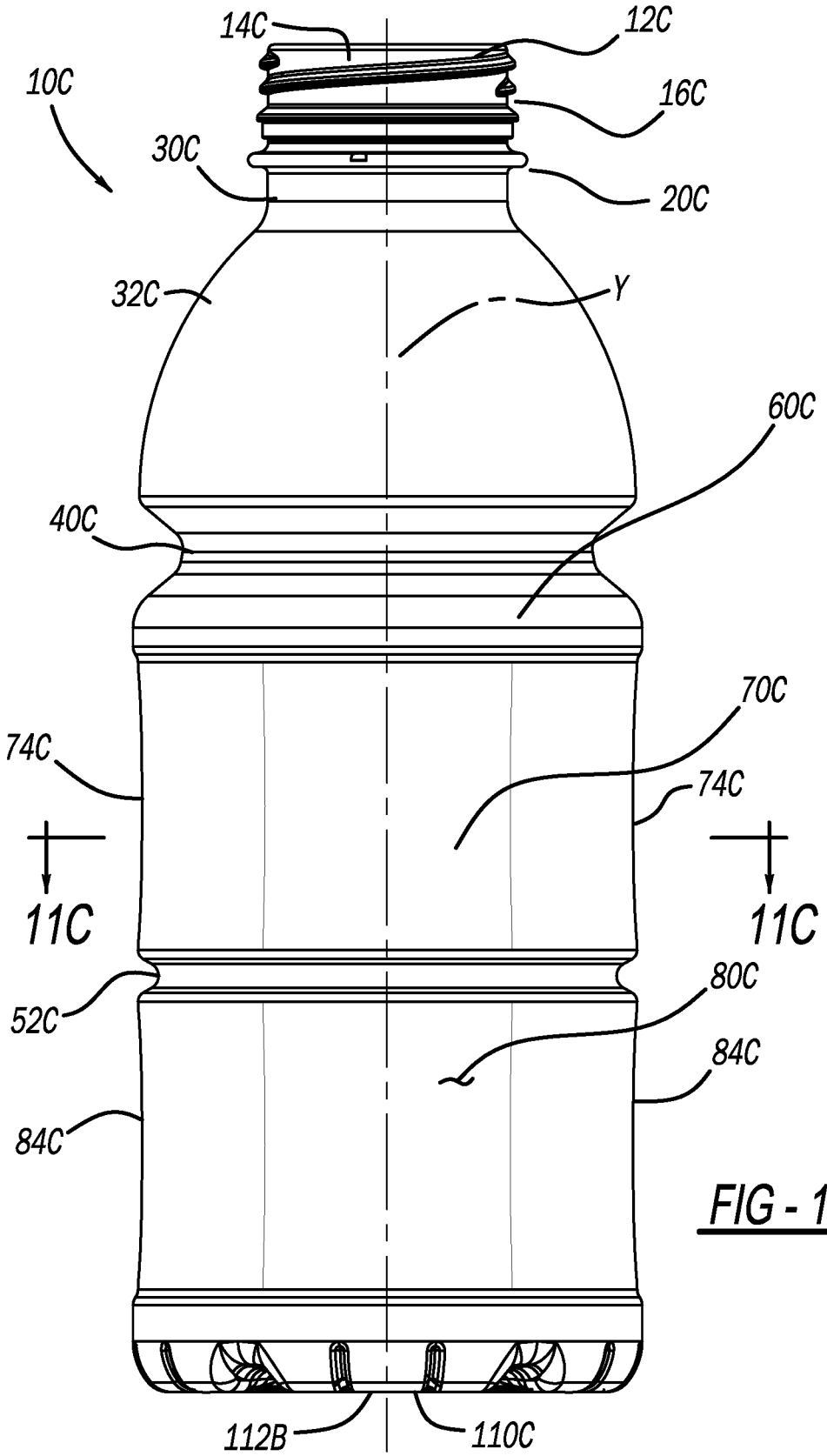
FIG. 11A is a side view of a third polymeric container in accordance with the present disclosure, the third polymeric container is in an as-blown, pre-filled configuration.
Figure 11B:
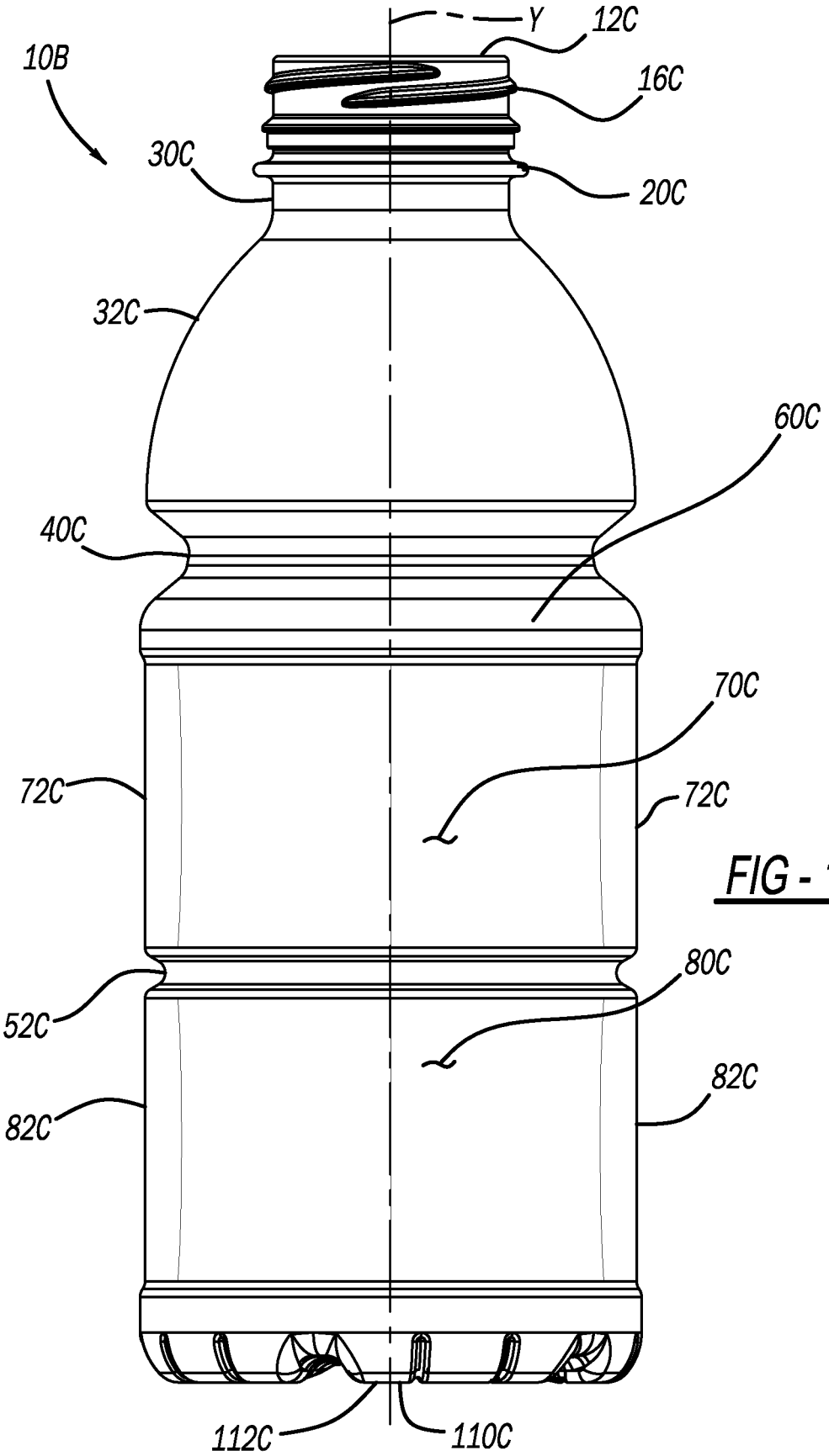
FIG. 11B is another side view of the third container of FIG. 11A.
Figure 11C:
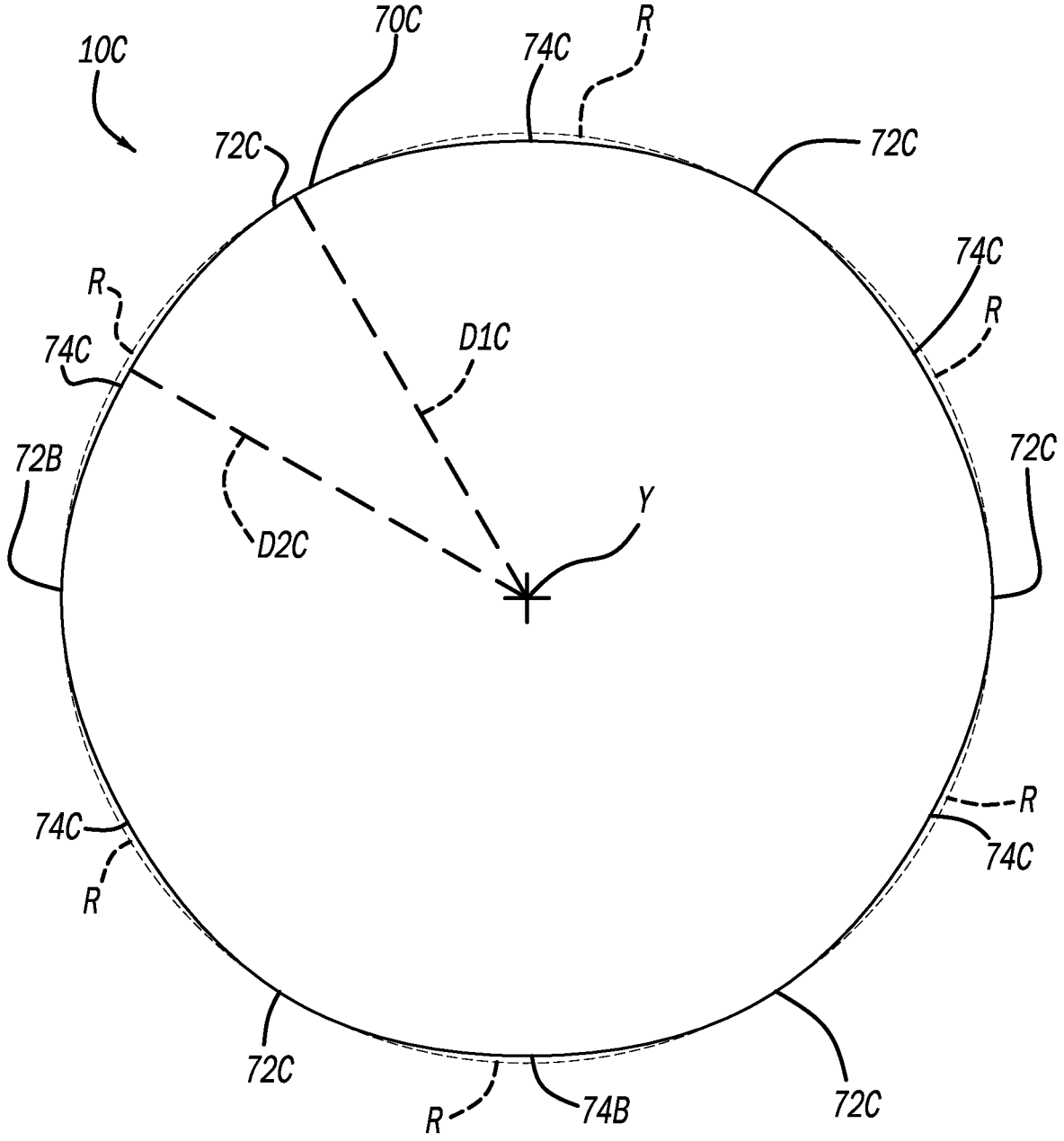
FIG. 11C is a cross-sectional view taken along line 11C-11C of FIG. 11A.
Figure 12A:
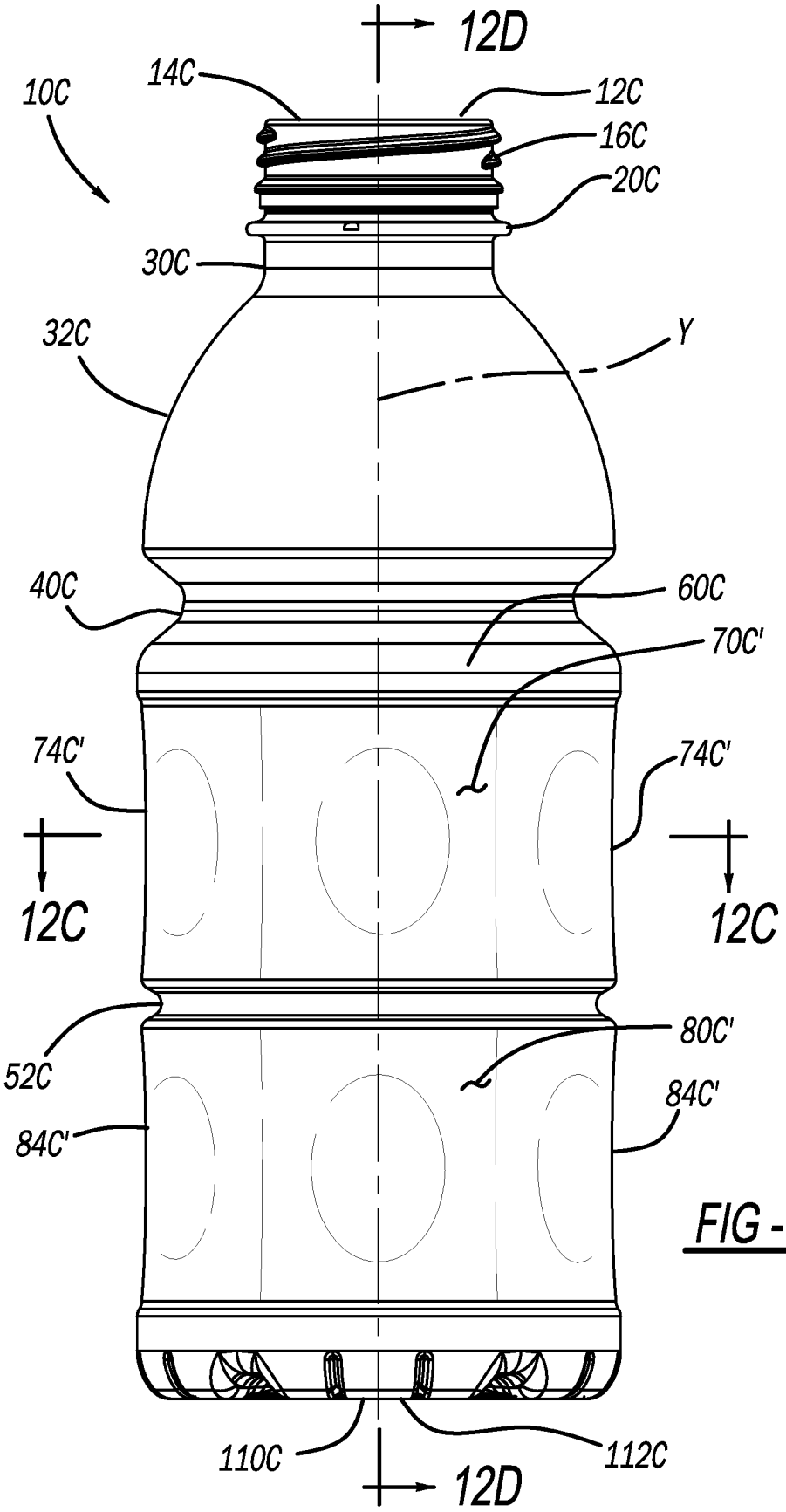
FIG. 12A is a side view similar to FIG. 11A of the third polymeric container, but with flexible panels thereof contracted in response to a vacuum within the container as a result of filling and capping the container.
Figure 12B:
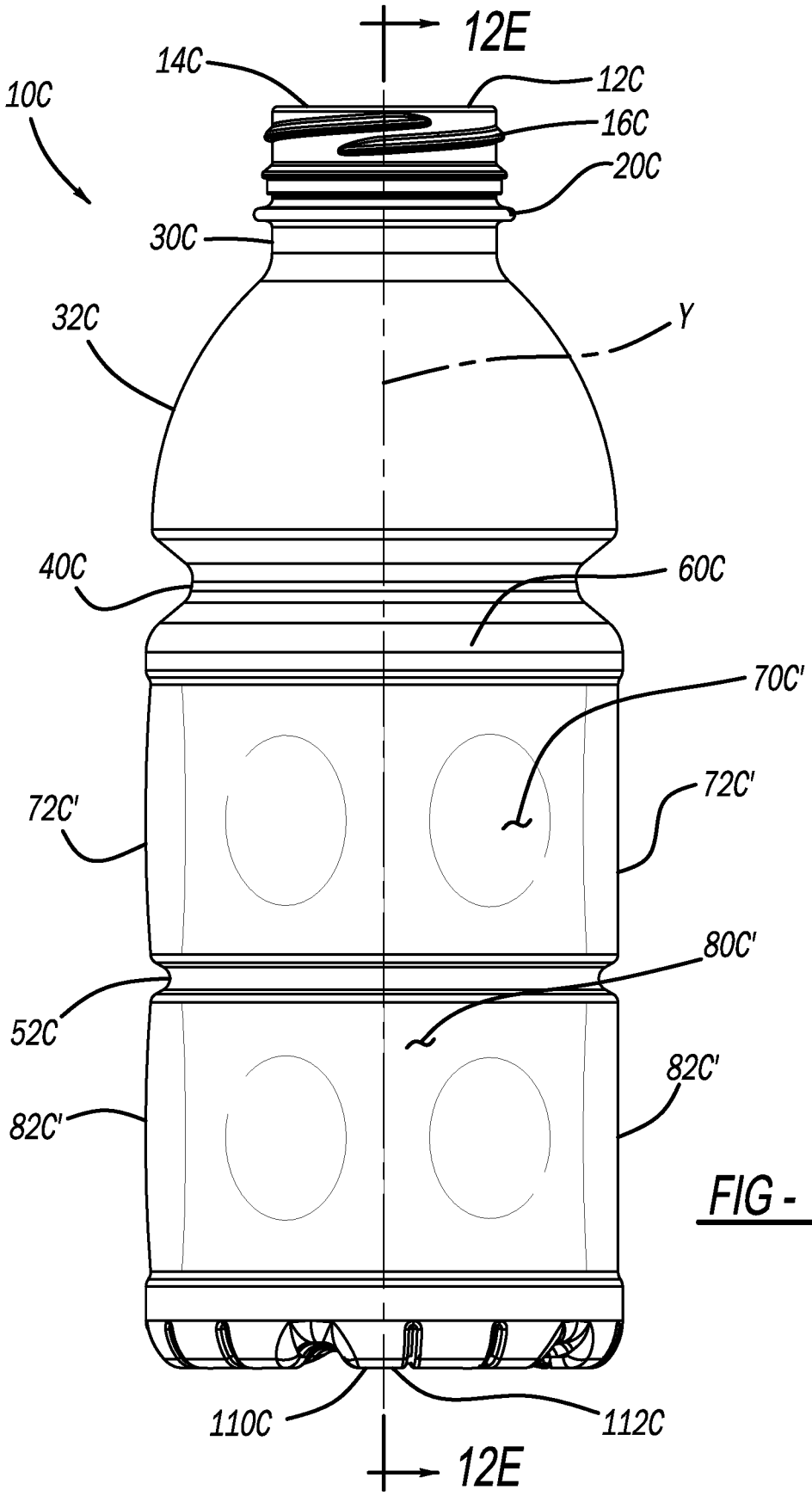
FIG. 12B is another side view of the third container with flexible panels thereof contracted.
Figure 12C:
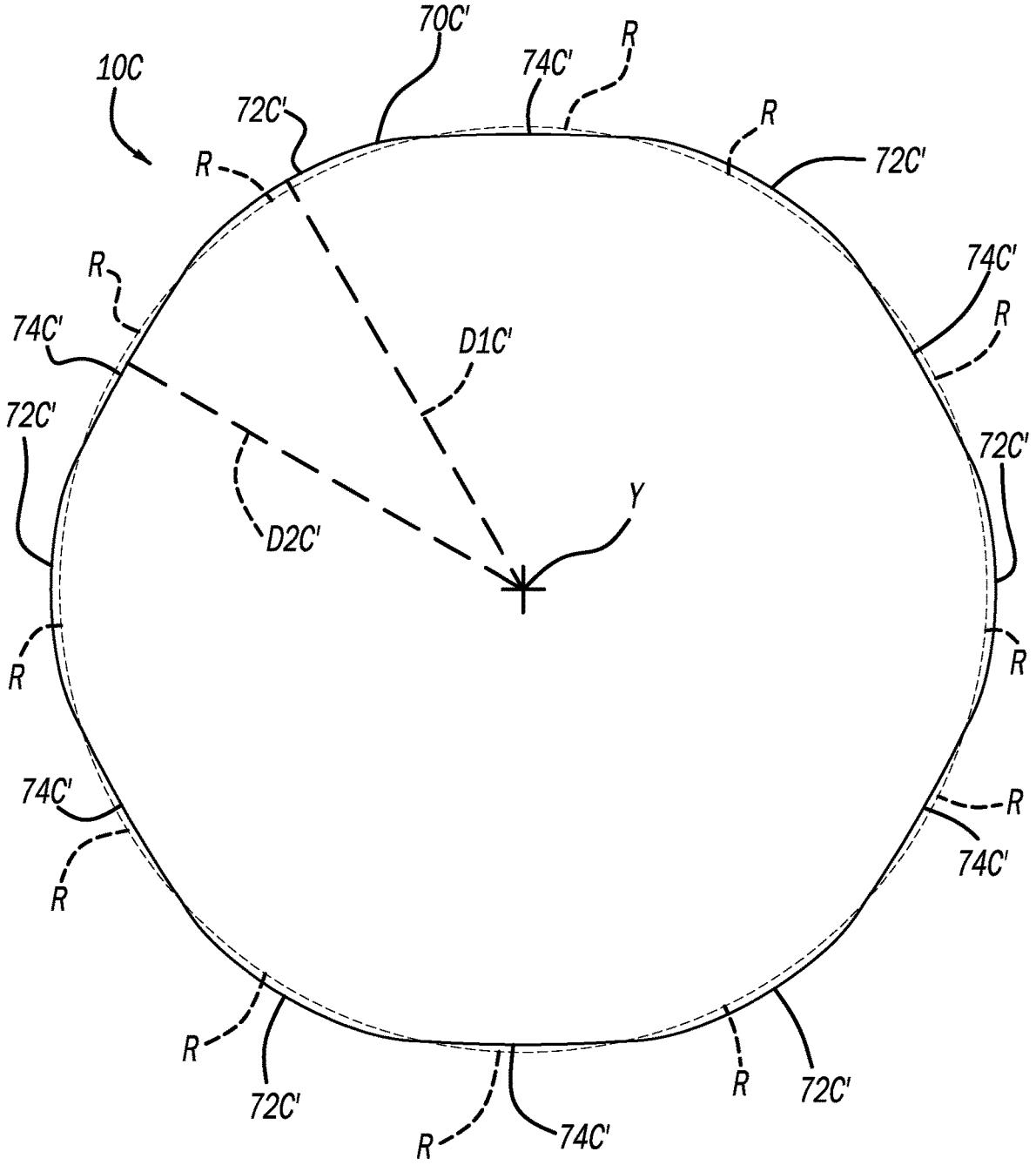
FIG. 12C is a cross-sectional view taken along line 12C-12C of FIG. 12A.
Figure 12D:
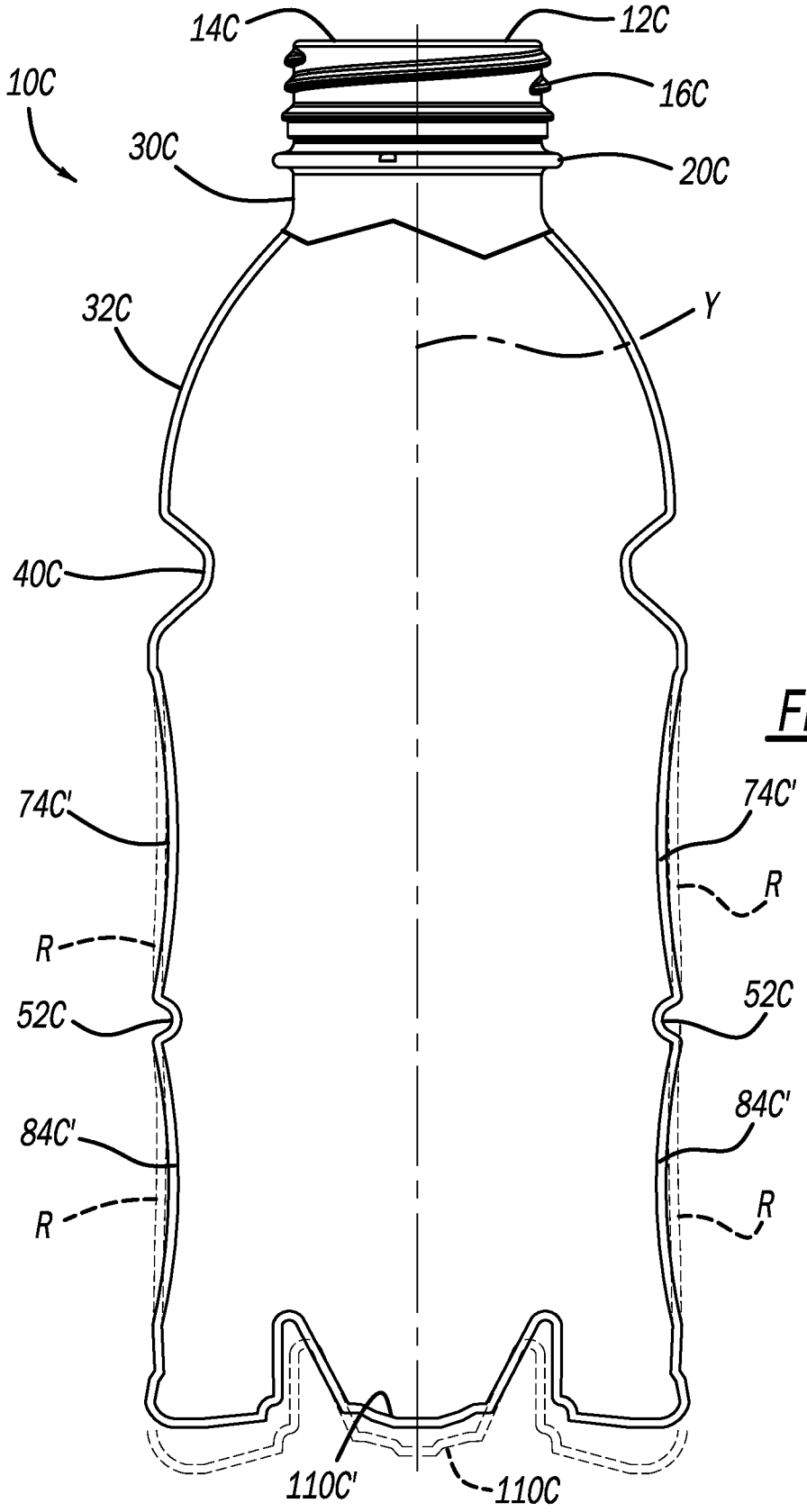
FIG. 12D is a cross-sectional view taken along line 12D-12D of FIG. 12A.
Figure 12E:
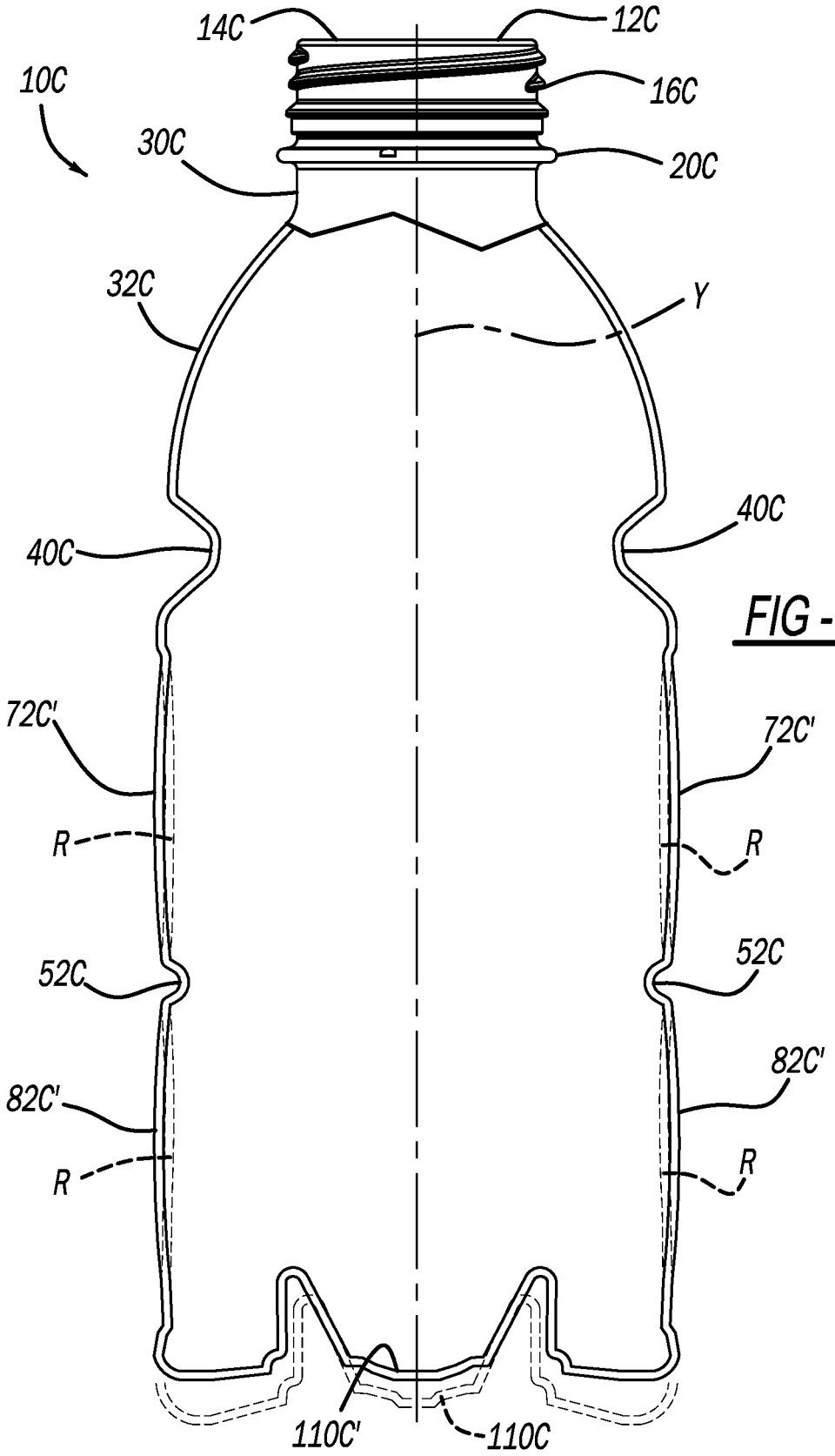
FIG. 12E is a cross-sectional view taken along line 12E-12E of FIG. 12B.
Figure 13A:
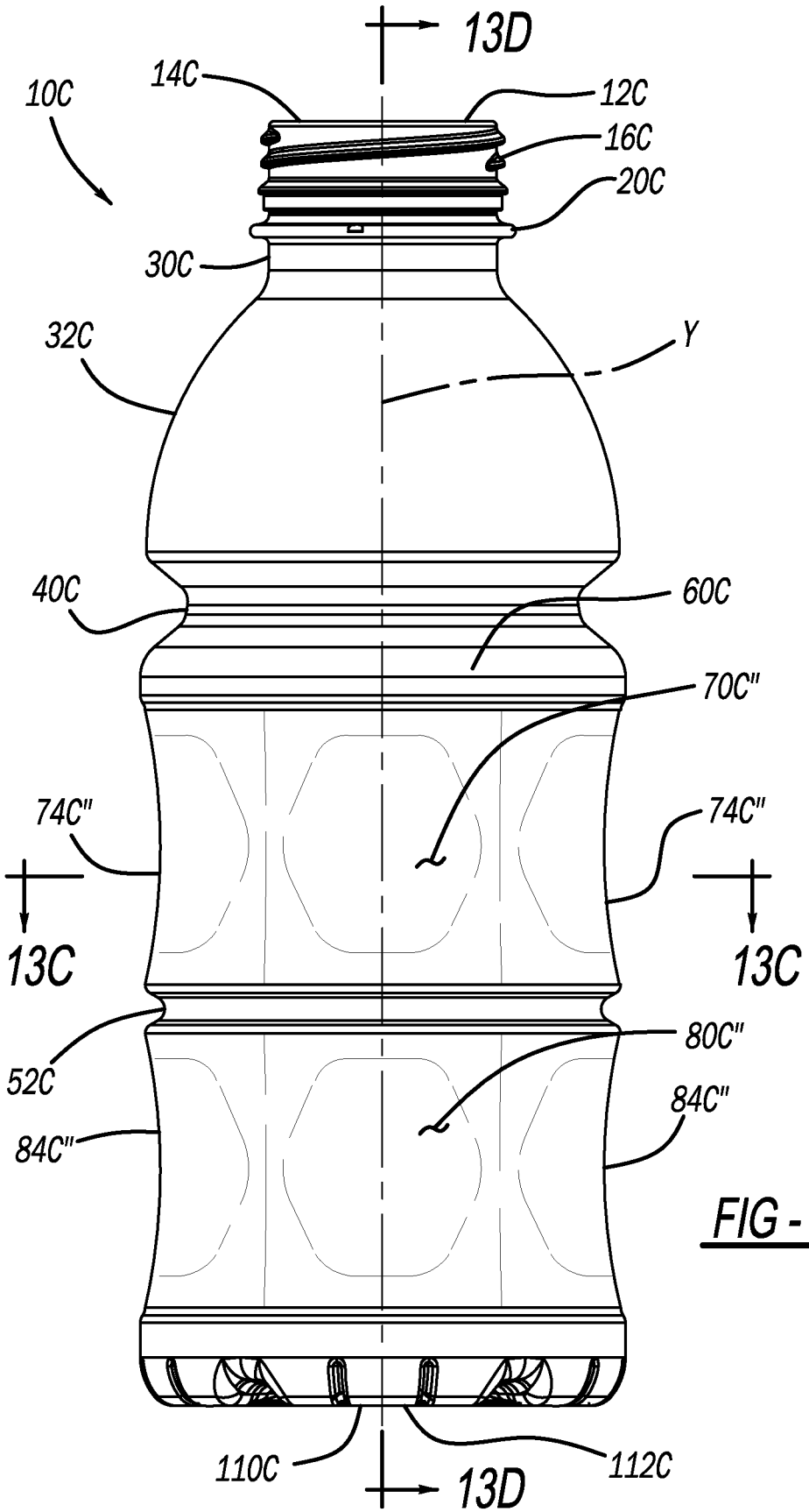
FIG. 13A is a side view similar to FIG. 12A of the third polymeric container, but with flexible panels thereof further contracted in response to additional vacuum within the container as a result of filling and capping the container.
Figure 13B:
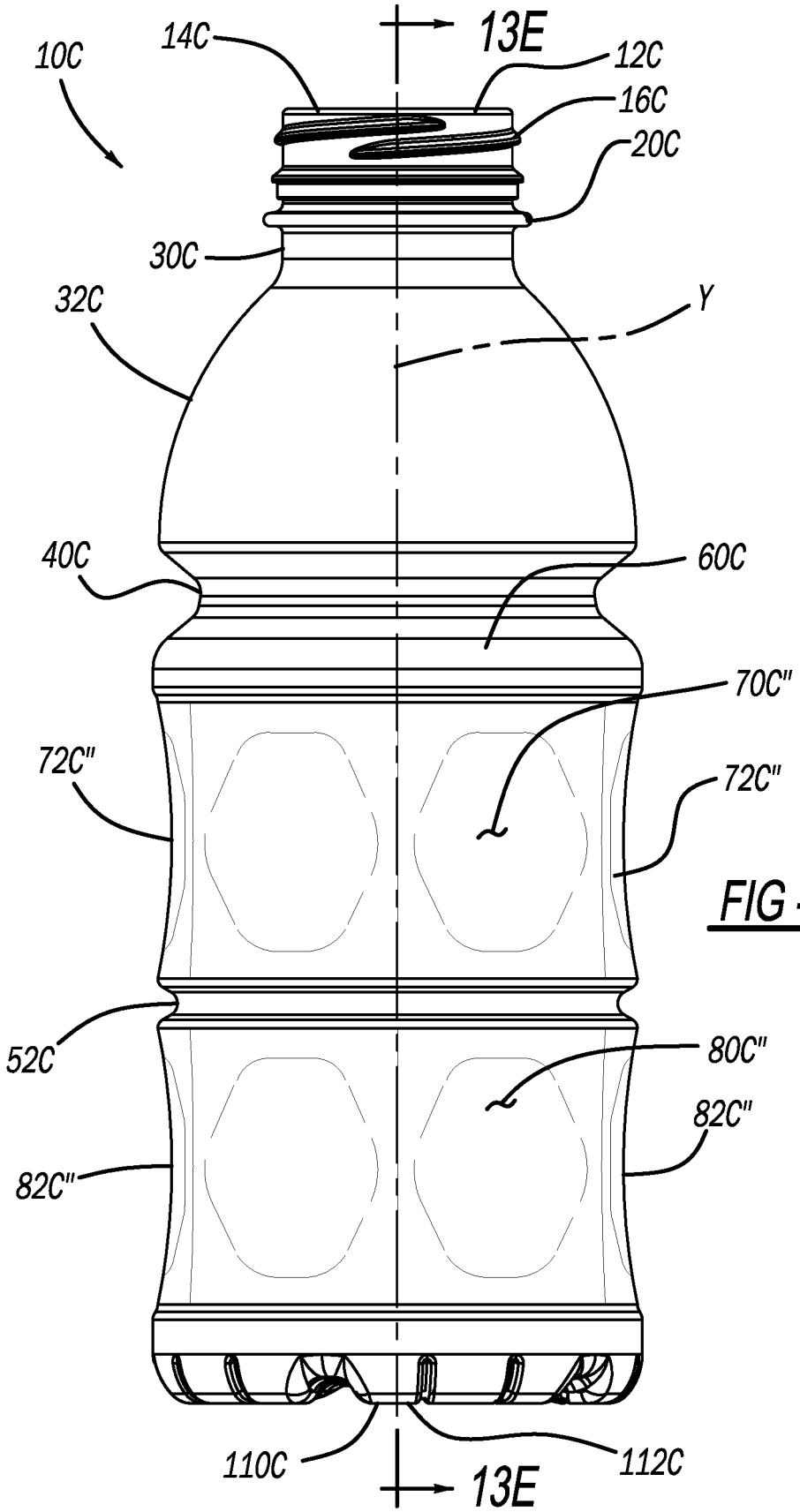
FIG. 13B is another side view of the container with the flexible panels thereof further contracted.
Figure 13C:
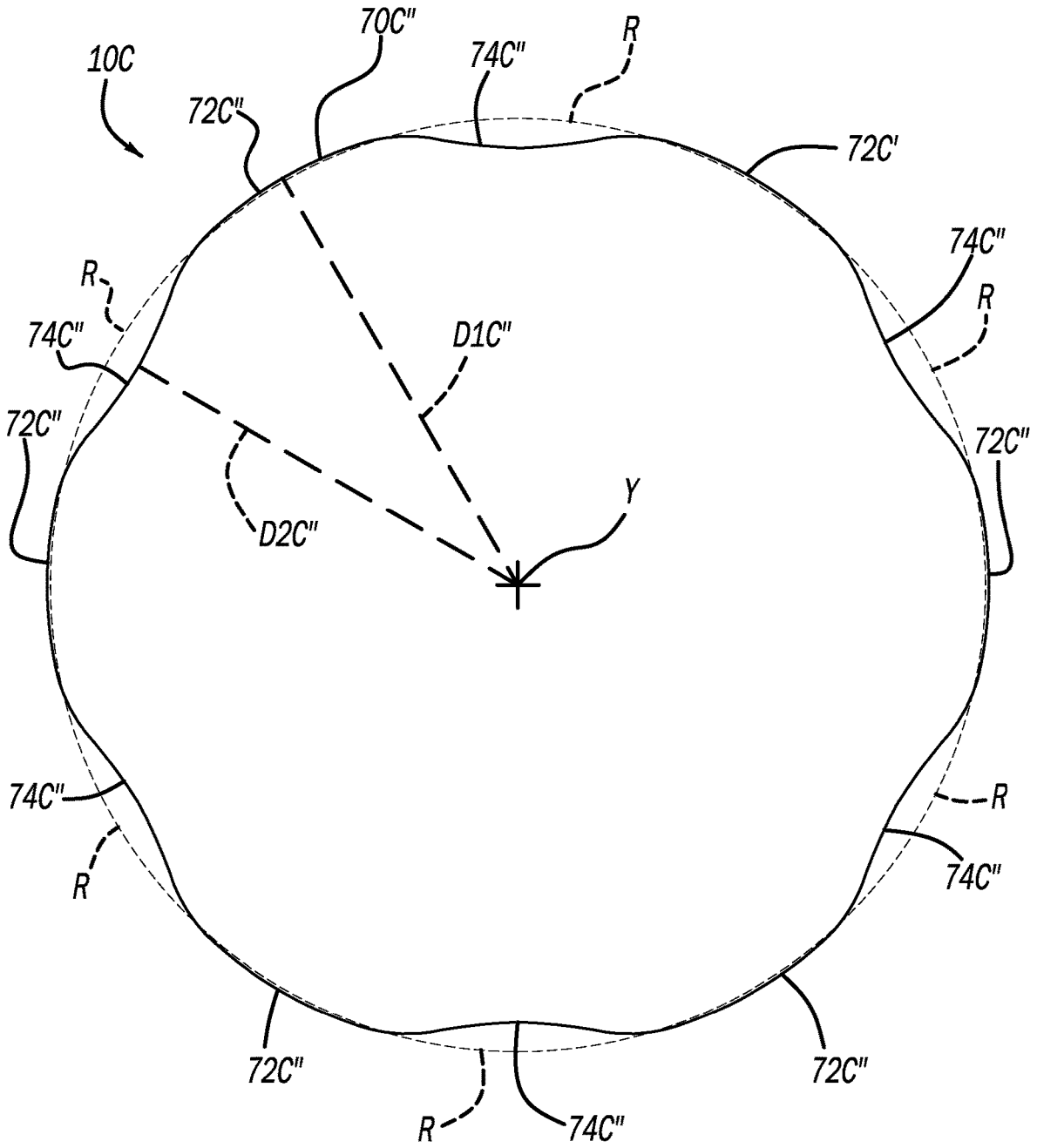
FIG. 13C is a cross-sectional view taken along line 13C-13C of FIG. 13A.
Figure 13D:
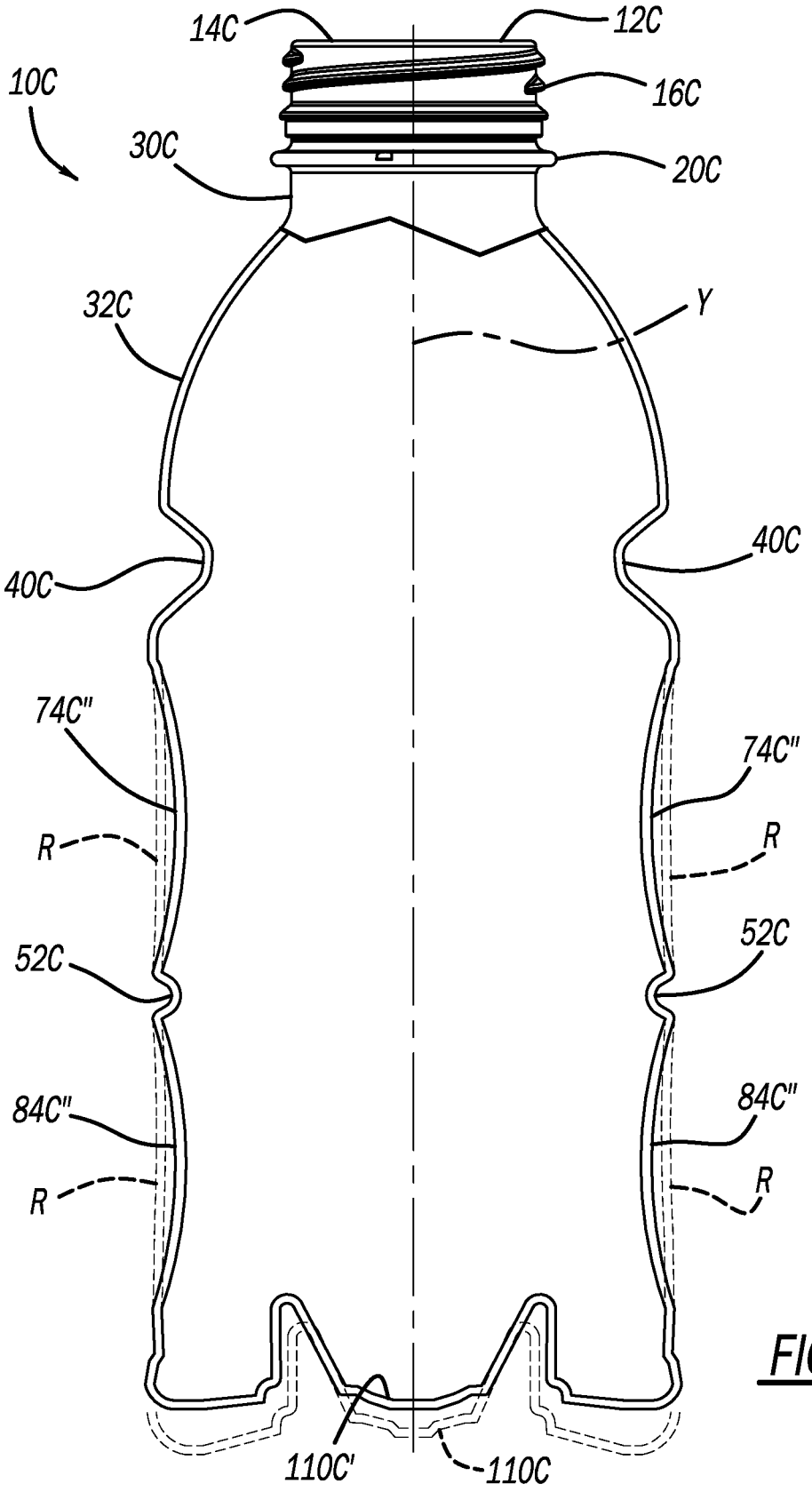
FIG. 13D is a cross-sectional view taken along line 13D-13D of FIG. 13A.
Figure 13E:
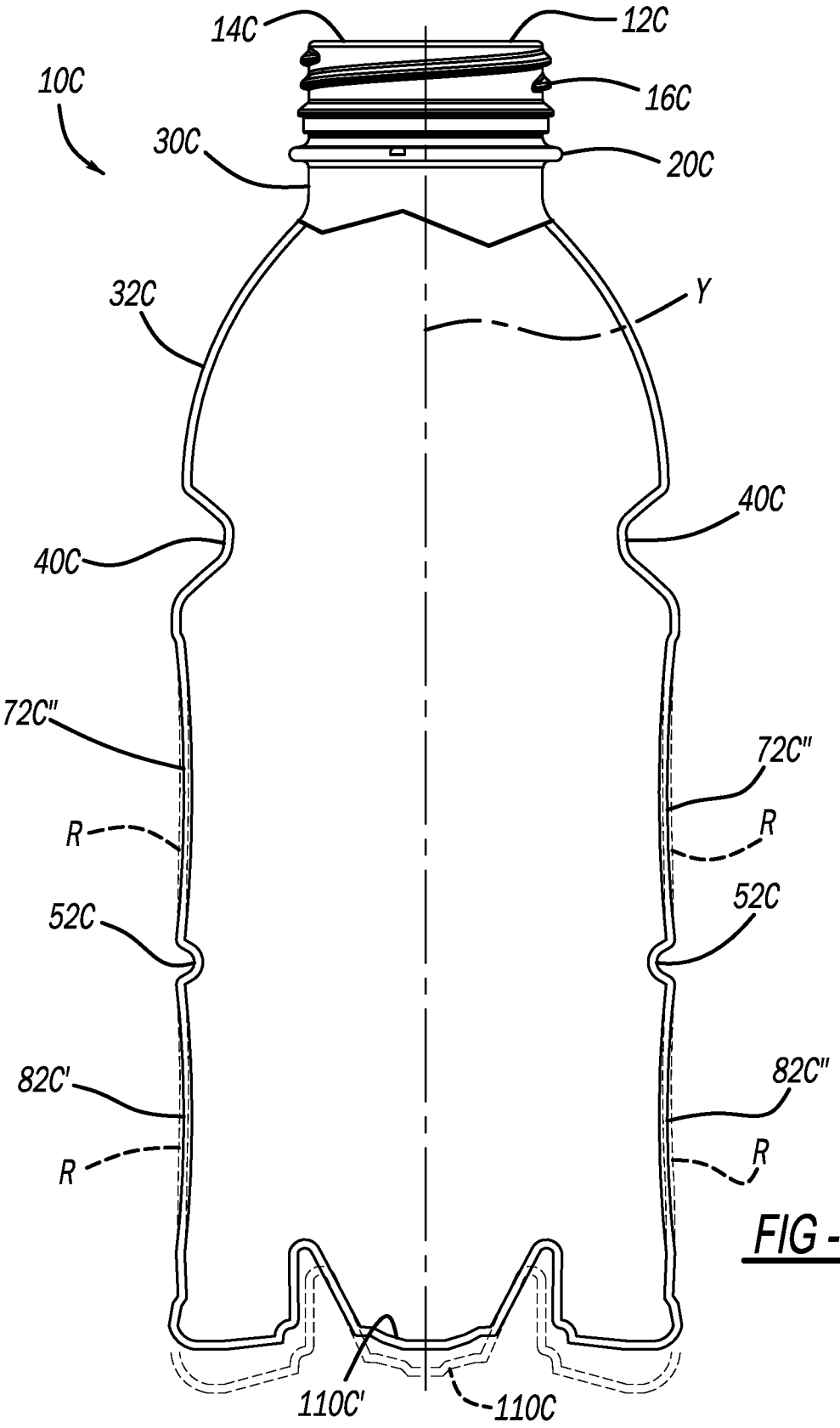
FIG. 13E is a cross-sectional view taken along line 13E-13E of FIG. 13B.

With reference to FIGS. 4 and 5, the flexible panels 70A and 80A can be configured such that different ones of the concave portions 74A and 84A respectively flex more towards the longitudinal axis y than others. For example, some of the concave portions 74A may be configured to flex to 74A', while others may be configured to flex to 74A". The concave portions 74A' and 74A" may alternate around the flexible panel 70A. The flexible panel 80A may be configured in the same manner or a similar manner.

In the example of FIG. 4, the vertically aligned concave portions 74A' and 84A" (as well as 74A" and 84A') are configured to flex inward at different rates in response to a vacuum within the container 10A. In the example of FIG. 5, vertically aligned concave portions 74A' and 84A' (as well as 74A" and 84A") are configured to flex inward at the same rate, while vertically offset concave portions 74A' and 84A" (as well as 74A" and 84A') are configured to flex inward at different rates.

FIGS. 6A-10 illustrate another exemplary container in accordance with the present disclosure at reference numeral 10B. Features of the container 10B that are the same as, or substantially the same as, the container 10A are identified in the drawings with the same reference numerals, but include the suffix "B" instead of "A." The description of the container 10A equally applies to the description of the container 10B at least with respect to these like features.

The rib 52B of the container 10B is rigid, which is in contrast to the flexible rib 52A of the container 10A. As a result, the flexible panels 70B and 80B move more than the flexible panels 70A and 80A in response to a vacuum within the container 10B. Thus, the difference between D1B and D1B' is greater than the different between D1A and D1A'; the difference between D2B and D2B' is greater than the difference between D2A and D2A'; the difference between D1B' and D1B" is greater than the difference between D1A' and D1A"; and the difference between D2B' and D2B" is greater than the difference between D2A' and D2A".

FIGS. 11A-15 illustrate another exemplary container in accordance with the present disclosure at reference numeral 10C. Features of the container 10C that are the same as, or substantially the same as, the container 10A are identified in the drawings with the same reference numerals, but include the suffix "C" instead of "A." The description of the container 10A equally applies to the description of the container 10C at least with respect to these like features.

Unlike the containers 10A and 10B, the container 10C does not include the ribs 50A and 54A. The container 10C does include rib 52C, which is a rigid rib like the rib 52B. As a result of not including the ribs 50A, 54A, the oscillations formed at the flexible panels 70C will absorb a greater amount of internal vacuum.

The present disclosure advantageously solves many problems associated with hot-filled thermoplastic containers by creating controlled modes of failure at the flexible panels 70A, 80A, which allows for fewer ribs to be utilized by the containers 10A, 10B, 10C, and a reduction in material thickness and weight. The resulting benefits are greater controlled vacuum performance, and higher topload at the first end 14A, 14B, 14C due to the capability to reduce or eliminate horizontal ribs in the container sidewall. The aforementioned benefits can also translate to higher efficiency, low vacuum, and aseptic applications, where complex, deep ribbed geometry can create greater dwell times in the sterilization chamber.

The oscillations formed at the flexible panels 70A, 70B, 70C, 80A, 80B, 80C due to the alternating concave portions 74A, 74B, 74C and columns 72A, 72B, 72C allow for acceptance of greater amounts of internal vacuum forces, which allows for a reduction of material weight, ribs or other sidewall features that can compromise topload, perpendicularity, or container shape. In lightweight hotfill containers, base supported filling has a minimum requirement for topload. Previous lightweight designs (>0.013") have required horizontal structural ribs that increase hoop strength and resist vacuum but reduce topload. The addition of the oscillations allows for ribs to be removed from the sidewall, due to their ability to uptake additional vacuum, thus increasing topload while enabling lower levels of material thickness. The reduction of ribs also leads to lower risk of container lean caused by uneven collapsing of ribs In addition to the structural support, the capability to reduce the number of ribs reduces the amount of aggressive protruding or receding features (such as ribs) in an aseptic package. Aseptic sterilization of packaging requires a calculated dwell time to both kill the appropriate level of microorganisms, and rinse and remove the sterilant from the packaging prior to fill. Reducing the amount of aggressive protruding or receding features can also reduce the dwell time, increasing the efficiency of aseptic sterilization. The oscillations also provide ergonomic gripping areas, accommodating various hand sizes and strength.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A polymeric container comprising:

a finish defining an opening of the container;

a base; and a body between the finish and the base, the body including a flexible panel extending entirely around the container, a longitudinal axis of the container extends through an axial center of the finish, the base, the body, and the flexible panel;

wherein the flexible panel includes alternating concave portions and vertically extending columns arranged about the flexible panel; and wherein in response to a vacuum within the container resulting from filling and capping the container, the concave portions are configured to flex inward towards the longitudinal axis to become more concave, and the vertically extending columns are configured to flex outward away from the longitudinal axis of the container.

2. The polymeric container of claim 1, wherein the vertically extending columns are further from the axial center than the concave portions.

3. The polymeric container of claim 1, wherein the vertically extending columns extend generally parallel to the longitudinal axis of the container prior to the vacuum; and wherein in response to the vacuum within the container the vertically extending columns are configured to flex outward away from the longitudinal axis to be convex.

4. The polymeric container of claim 1, wherein the flexible panel has a thickness of 0.330 mm or less.

5. The polymeric container of claim 2, wherein the flexible panel includes 4-8 of the plurality of concave portions and 4-8 of the vertically extending columns.

6. The polymeric container of claim 1, wherein the flexible panel is one of a plurality of flexible panels each including alternating concave portions and vertically extending columns.

7. The polymeric container of claim 1, wherein the flexible panel is between a first horizontal rib and a second horizontal rib.

8. The polymeric container of claim 7, wherein the first horizontal rib and the second horizontal rib are flexible in the vertical direction.

9. The polymeric container of claim 7, wherein the first horizontal rib and the second horizontal rib are rigid.

10. The polymeric container of claim 7, wherein one of the first horizontal rib and the second horizontal rib have different degrees of flexibility.

11. The polymeric container of claim 1, wherein the plurality of concave portions are configured to become more concave and round in response to the vacuum at a first vacuum level.

12. The polymeric container of claim 11, wherein the plurality of concave portions are configured to become more concave and hexagonal in response to an increase in the vacuum from the first vacuum level to a second vacuum level that is greater than the first vacuum level.

13. The polymeric container of claim 1, wherein a minimum diameter of the flexible panel is 0.25 mm-2.5 mm less than a maximum diameter of the flexible panel.

14. The polymeric container of claim 1, wherein a minimum diameter of the flexible panel is 0.60 mm less than a maximum diameter of the flexible panel.

15. The polymeric container of claim 14, wherein the minimum diameter is at two opposing ones of the plurality of concave portions.

16. The polymeric container of claim 1, wherein a radius of one of the vertically extending columns is half a maximum diameter of the container.

17. The polymeric container of claim 1, wherein the plurality of concave portions are 40%-90% of a total surface area of the flexible panel.

18. The polymeric container of claim 1, wherein the base absorbs or displaces a portion of the internal vacuum.

19. The polymeric container of claim 1, wherein the flexible panel is a first flexible panel, and the plurality of concave portions are first concave portions;

wherein the body includes a second flexible panel having a plurality of second concave portions spaced apart at regular intervals about the entirety of the body; and wherein in response to the increase in vacuum within the container during filling and capping of the container, the plurality of second concave portions flex inward towards the axial center of the container to become more concave.

20. The polymeric container of claim 19, wherein the plurality of first concave portions are vertically aligned with the plurality of second concave portions.

21. The polymeric container of claim 19, wherein the plurality of first concave portions are vertically offset from the plurality of second concave portions.

22. The polymeric container of claim 20, wherein in response to the increase in vacuum within the container, the first concave portions and the second concave portions are configured to flex inward towards the longitudinal axis of the container at different rates from each other.

23. The polymeric container of claim 20, wherein in response to the increase in vacuum within the container, the first concave portions and the second concave portions are configured to flex inward towards the longitudinal axis of the container at identical rates to each other.

* * * * *